United States Patent [19]

Nagarwalla et al.

[11] Patent Number: 4,832,108

[45] Date of Patent: May 23, 1989

[54] METHOD AND APPARATUS FOR HANDLING TOOLING WITHIN A FOUNDRY MACHINE

[75] Inventors: Pheroze J. Nagarwalla, Rochester Hills; Jackson E. Brown, Mt. Clemens; Kenneth E. Bellis, Rochester, all of Mich.

[73] Assignee: Robert Corporation, Lansing, Mich.

[21] Appl. No.: 237,621

[22] Filed: Aug. 23, 1988

Related U.S. Application Data

[63] Continuation of Ser. No. 34.233, Apr. 2, 1987, abandoned.

[51] Int. Cl.[4] ..... B22C 17/02

[52] U.S. Cl. ..... 164/180; 164/186; 164/200; 164/226; 164/12; 164/16

[58] Field of Search ..... 164/4.1, 456, 12, 15, 164/16, 19, 20, 21, 23, 27, 28, 29, 150, 154, 180, 186, 192, 193, 200, 201, 202, 213, 228, 233, 401, 226

[56] References Cited

U.S. PATENT DOCUMENTS

| | | | |
|---|---|---|---|
| 3,007.216 | 11/1961 | Johnston | 164/193 |
| 3,096,547 | 7/1963 | Hunter et al. | 164/200 |
| 3,556,195 | 1/1971 | Lund | 164/201 |
| 4,100,961 | 7/1978 | Goss et al. | 164/180 |
| 4,673,022 | 6/1987 | Mitzner | 164/137 |

FOREIGN PATENT DOCUMENTS

| | | | |
|---|---|---|---|
| 1170834 | 11/1969 | United Kingdom | 164/180 |
| 2024070 | 1/1980 | United Kingdom | 164/200 |

*Primary Examiner*—Richard K. Seidel
*Attorney, Agent, or Firm*—Thomas K. Ziegler; Raymond J. Eifler

[57] ABSTRACT

A foundry machine for forming molds or cores from a molding material such as sand provides completely automated loading and unloading of tooling elements (24). The tooling elements (24) comprising a sand magazine (36), blow plate (34), combined gassing manifold and top ejector unit (32), upper mold box (30), lower mold box (28) and bottom stool (26) are automatically transferred, in stacked, separable relationship, by tracks (40) to a vertically displaceable, work table. Vertical displacement of the work table (42) sequentially elevates the tooling elements (24) to positions within a mainframe (10) where automatically operated clamping means secure the appropriate tooling elements (24) in respective operating positions. The gassing manifols (32) includes an ejector pin assembly (274, 280) mounted therewithin.

15 Claims, 24 Drawing Sheets

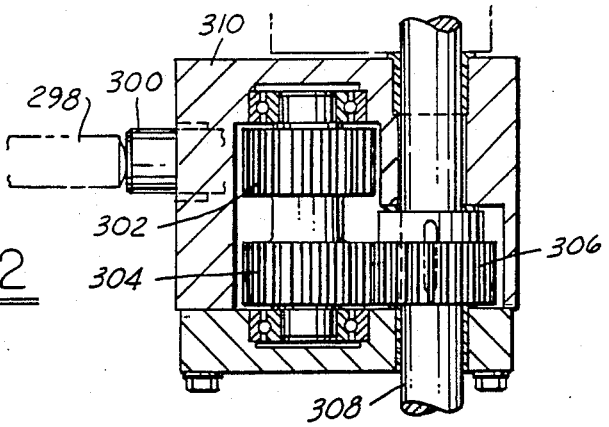
FIG.42
FIG.44
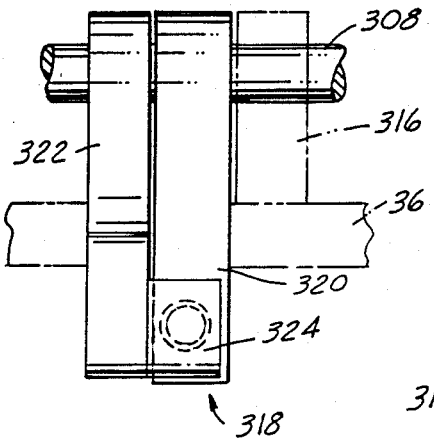
FIG.43
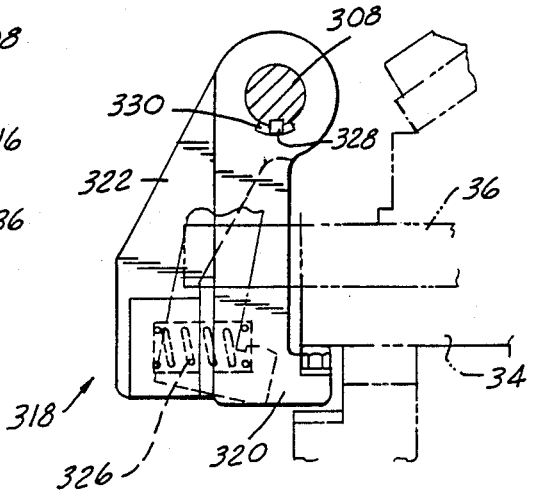

METHOD AND APPARATUS FOR HANDLING TOOLING WITHIN A FOUNDRY MACHINE

This is a continuation of co-pending application Ser. No. 07/034,233 filed on Apr. 2, 1987 now abandoned.

This invention relates to a foundry machine for forming molds or cores by an automated process.

In foundry molding machines wherein molds or cores for use in subsequent casting operations are formed out of molding materials such as sand, it is common to place onto a vertically movable work table the upper and lower cavity-containing mold halves, known as the cope and drag, respectively. The table is movably mounted in a fixed frame, the upper portion of which contains a sand hopper, appropriate valving, and a blow head and blow plate adapted to blow sand downwardly into the mold cavity. The table is adapted to lift the stacked mold boxes into communication with the underside of the blow plate for filling or charging the mold box cavity with sand, following which the mold boxes are lowered and curing means, such as a catalyzing gas manifold, are transferred into engagement with the lowered mold boxes to inject a sand-curing gas into the mold cavity. Following this step, means are provided for vertically separating the upper and lower mold boxes, ejecting the newly-formed part and automatically conveying the part away.

An exemplary prior art patent showing such construction is U.S. Pat. No. 4,100,961 to Goss et al.

In the prior art Goss patent, no means are provided for automatically conveying associated tooling, such as the sand magazine and blow plate, into position and automatically clamping them to the blow head or blow sleeve. Furthermore, the Goss device requires two separate transfer mechanisms for the curing head and the upper ejector mechanism. It would be highly advantageous to be able to further automate the foundry molding machine by the provision of means to initially convey, locate and secure to the mainframe associated tooling such as the sand magazine, blow plate, gassing manifold and top ejector means.

SUMMARY OF THE INVENTION

According to one aspect of the present invention, a method and apparatus is provided for initially loading onto the work table of the mainframe tooling which includes the upper and lower mold boxes and a combined gassing manifold and ejector unit, then removing the combined gassing manifold and ejector unit from the remaining portions of the tooling and transferring such unit to a stand-by position, thereafter raising the molds into engagement with the molding material supply means for filling of the molds to form the desired part, lowering the molds on the work table to a position wherein the combined gassing manifold and ejector unit can once again be stacked with the mold boxes, connecting such unit to a source of catalyzing gas and thereafter curing the formed part, separating the upper and lower mold boxes and ejecting the formed part thereform.

According to another aspect of the invention, the tooling which is initially placed on the work table may also include one or more of the sand magazine, blow plate and lower ejector unit, all of which components are automatically located and clamped in place at the proper point in the cycle.

According to another aspect of the invention, an improved gassing manifold is disclosed wherein a portion of the upper ejector pin mechanism is contained within the gassing manifold chamber, with the ejector pins extending through openings in the bottom plate of said chamber which also serve as the curing gas exit ports.

An advantage of this invention is in the substantially increased degree of automation of the operating cycle of a foundry machine, wherein all of the tooling associated with the molds for a particular part can be automatically loaded onto the work table, lifted to its proper position by the work table, and clamped in place at the proper cycle, thereby saving time and labor associated with changing or servicing the tooling.

It is another advantage of the invention that the gassing manifold is combined in a single unit with the top ejector plate mechanism, thereby saving floor space and reducing the complexity and amount of transfer mechanism and controls.

BRIEF DESCRIPTION OF THE DRAWINGS

FIG. 42 is a sectional plan view in the direction of arrows 42—42 of FIG. 41.

FIG. 43 is an enlarged front view of a blow plate clamp, viewed in the direction of arrows 43—43 of FIG. 38.

FIG. 44 is a side view of the clamp of FIG. 43.

DETAILED DESCRIPTION OF THE INVENTION

In the following description, the invention has been described as applied to the making of cores. However, as will be understood by those skilled in the art, the features of the invention are also applicable to the making of molds. Hence, reference to cores is for convenience and is not to be interpreted as limiting. Similarly, the terms "core boxes" and "mold boxes" may be used interchangeably herein.

Figure 1:
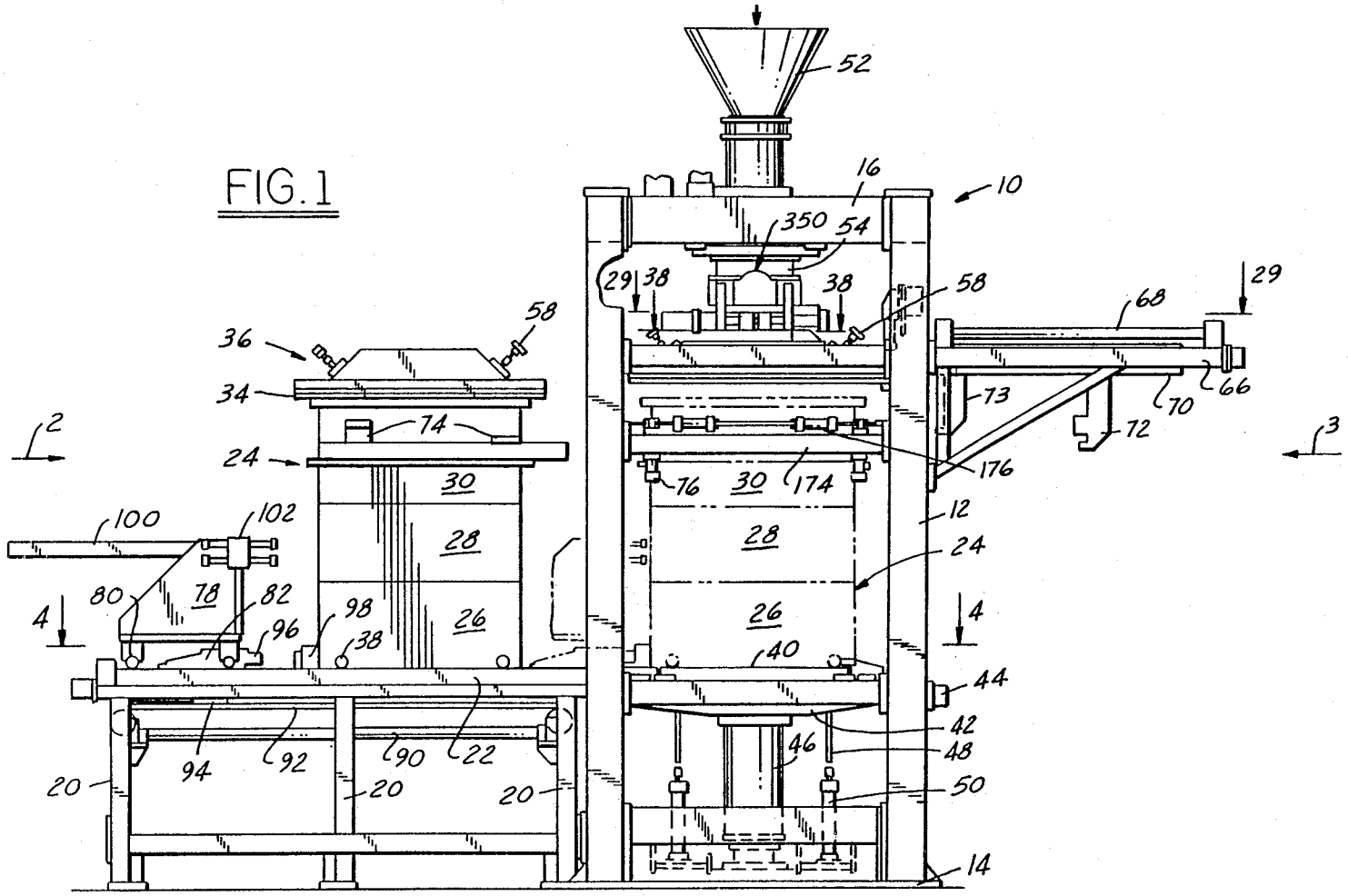
FIG. 1 is a front view of the foundry machine of the present invention, showing the tooling in solid lines on the loading table and in phantom lines on the work table.
Figure 3:
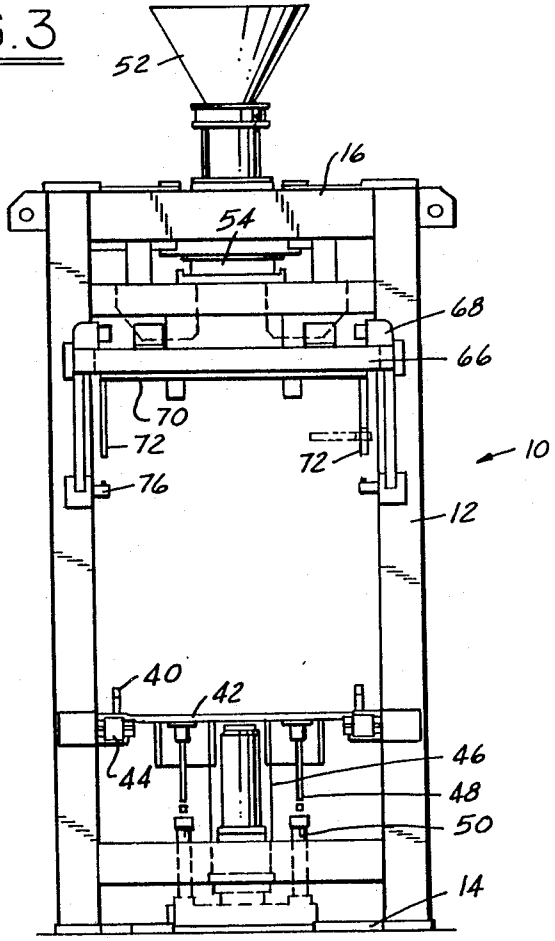
FIG. 3 is a right side view in the direction of arrow 3 of FIG. 1.
Figure 2:
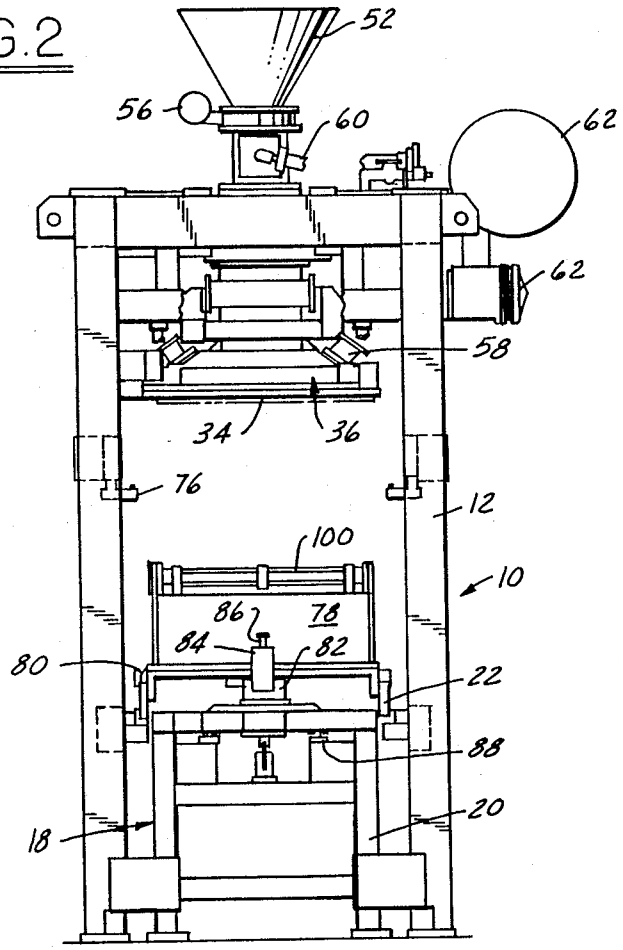
FIG. 2 is a left side view in the direction of arrow 2 of FIG. 1.

Referring to FIGS. 1–3 of the drawings, which show the overall arrangement of the principal components of the invention, the improved core-making machine of this invention comprises a mainframe 10 which includes four posts 12 interconnecting base plate 14 and horizontal upper beams 16.

To one side of mainframe 10 there is mounted tool-loading and pick-off table 18, which comprises vertical legs 20 supporting horizontal rails 22 which in turn support and guide tooling 24. Tooling 24 comprises a series of stacked components including bottom stool 26, lower core box or drag 28, upper core box or cope 30, gassing manifold and ejector plate 32, blow plate 34 and sand magazine 36. Drag 28 and cope 30 contain cavities (not illustrated) for the core which is to be formed. These elements of the tooling are stacked on top of each other as a single unit when the tooling is initially installed on the tool-loading and pick-off table 18. Alternatively, gassing manifold and ejector plate 32, blow plate 34 and sand magazine 36 can be left in place within mainframe 10 following a previous operation, and not loaded along with the mold boxes and stool.

Bottom stool 26 is provided with wheels 38 that permit the tooling to roll along rails 22 and onto pivotable rails 40 which are aligned with rails 22 and pivotally secured to mainframe 10. Rails 40 are adapted to pivot out of the path of vertically moving clamping table 42 by means of hydraulic rotary actuators 44. FIG. 1 illustrates tooling 24 in its initial position on tool-loading and pick-off table 18, and also shows in phantom the tooling in position on rails 40 of mainframe 10 after it has been automatically moved into such position by the mechanism to be described below.

Also illustrated in FIGS. 1 and 3 is the telescoping table clamp cylinder 46 which functions to raise and lower tool clamping table 42. The lower end of cylinder 46 is fixed to base 14, while the extendable outer cylinder sleeve is secured to the underside of table 42. Adjacent to table lifting cylinder 46 there is mounted a series of lower ejector pin actuators 48 which are actuated by ejector cylinders 50 to eject the core from lower core box 28 following formation and curing of the core.

Still referring to FIGS. 1 and 2, sand is loaded into the system by means of sand hopper 52 which interconnects with blow plate 34 and sand magazine 36 by means of blow sleeve 54. The flow of sand, which generally includes a binder, is controlled by a butterfly valve (not illustrated) and hopper valve actuator 56, while air is permitted to escape during the sand charging operation by means of sand magazine exhaust vent valves 58 and exhaust valve 60. Blowing air is supplied from pressurized air tank 62 under the control of blow valve control 64.

FIGS. 1 and 3 also illustrate a mechanism for transferring the gassing manifold and ejector plate 32 between its operating and stand-by positions. A support frame 66 mounted on mainframe 10 carries a pair of hydraulic cylinders 68 which are connected to a transfer carriage 70 from which depend hanger brackets 72 and 73 which engage retainer brackets 74 on gassing manifold and ejector plate 32. Further details of the construction and operation of this transfer mechanism will be discussed below.

FIGS. 2 and 3 also illustrate a series of cope hangers 76 which are pivotally mounted on frame crossmember 174 under the control of hydraulic cylinders 176 and which function to support the upper core box or cope during certain phases of the machine cycle.

FIGS. 1 and 2 also illustrate a trolley and carriage mechanism which functions both to transfer tooling 24 into and out of the work station of mainframe 10 and also to pick off and remove the completed core from the tooling. Trolley 78 has wheels 80 which ride along tracks 22. Trolley 78 engages a horizontally movable carriage 82 for movement therewith by means of latch 84 and latch pin 86. Carriage 82 is supported for horizontal movement by means of guide supports 88, while movement of the carriage and trolley is controlled by a hydraulic transfer cylinder 90 operating through cable 92 and its connection 94 to the carriage.

Figure 4:
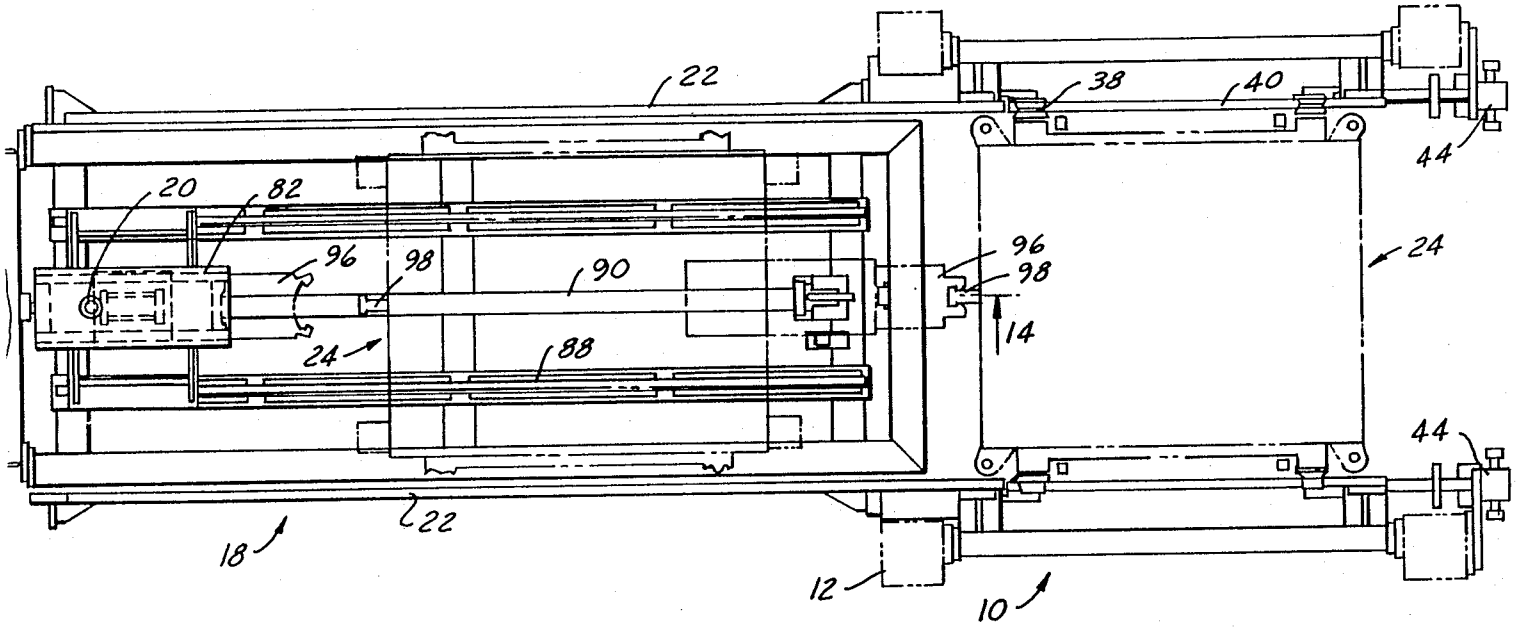
FIG. 4 is a plan view, partly in phantom, in the direction of arrows 4—4 of FIG. 1.

The plan view of FIG. 4, which shows tooling 24 in phantom (in both of its positions) and omits trolley 78 for clarity, shows gripper jaws 96 which form a portion of carriage 82 and which are adapted to releasably engage and grip coupling 98 which forms a portion of bottom stool 26 of tooling 24. The actuation means for jaws 96 will be further described below.

FIGS. 1 and 2 also illustrate pick-off unit 100 which is pivotally mounted on trolley 78 under the control of hydraulic rotary actuator 102. As will be further explained below, pick-off unit 100 may be pivoted from its illustrated retracted position to an extended condition wherein it removes a completed and ejected core from the core boxes and transports the core out of the work station within mainframe 10.

Figure 5:
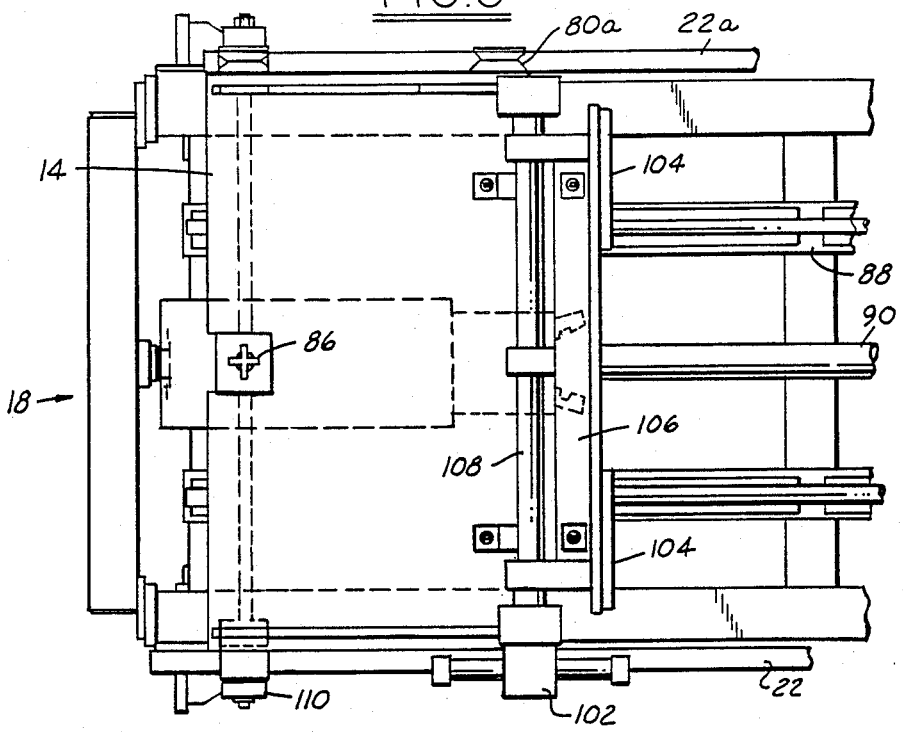
FIG. 5 is a fragmentary plan view of a portion of the trolley and loading table.
Figure 6:
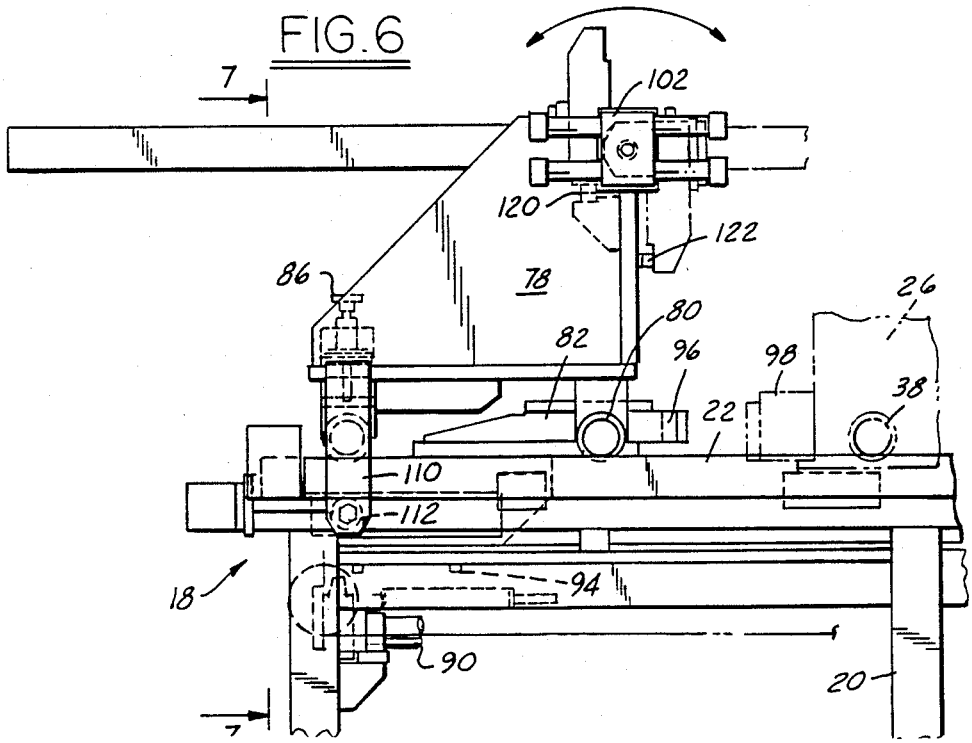
FIG. 6 is a front view of the apparatus shown in FIG. 5.

FIGS. 5 and 6 show further details of trolley 78 and pick-off unit 100. In the fragmentary plan view of FIG. 5, the fingers of the pick-off unit have been omitted for clarity. The fingers are adapted to be secured to mounting plates 104, which are in turn secured to bracket 106 which is clamped to pick-off finger pivot shaft 108. Pivot shaft 108 is selectively rotatable through approximately 180 degrees under the control of rotary actuator 102.

As shown in the fragmentary front elevational view of FIG. 6, trolley 78 is provided with downwardly extending hold-down brackets 110, on the lower end of which are secured rollers 112 which engage the lower face of rails 22. These rollers stabilize the trolley and prevent it from tipping, particularly when the pick-off fingers are supporting a completed core.

Figure 7:
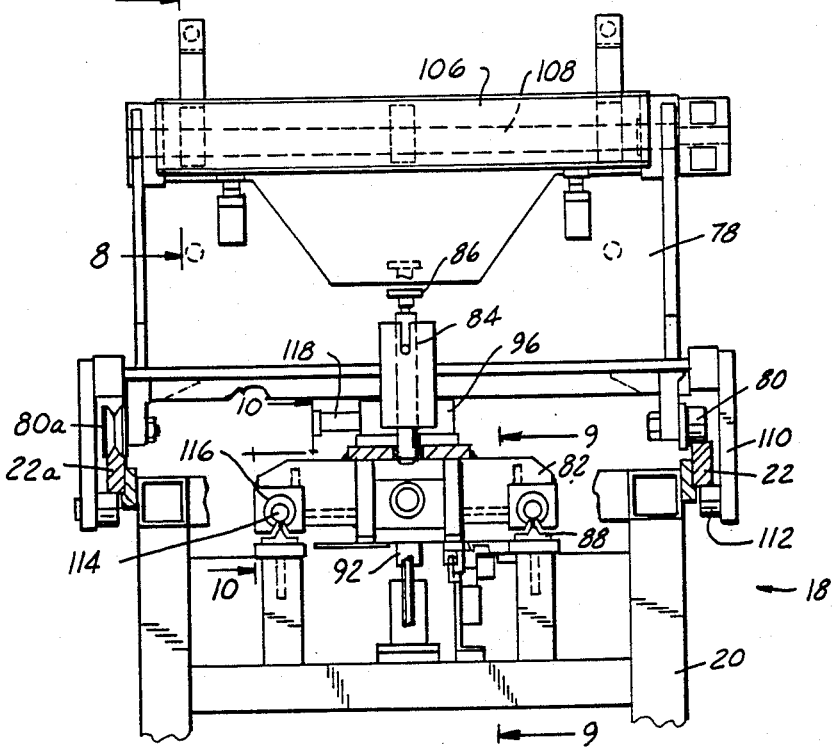
FIG. 7 is a left side view in the direction of arrows 7—7 of FIG. 6.

FIG. 7 shows additional details of the carriage and trolley. Previously mentioned carriage guide supports 88 support longitudinally extending carriage guide rods 114. Carriage 82 is provided with bushings 116 which engage and slidably grip guide rods 114. In this manner, carriage 82 is supported and guided during its longitudinal movement toward and away from mainframe 10.

FIG. 7 also illustrates hydraulic cylinder 118 which controls the opening and closing of gripper jaws 96 on carriage 82. As shown on the left side of FIG. 7, and in contrast to the configuration of the corresponding elements on the righthand side of the figure, rail 22*a* and trolley wheel 80*a* have cooperating V-shaped profiles to maintain the trolley in its desired lateral position as it moves along the rails.

Figure 8:
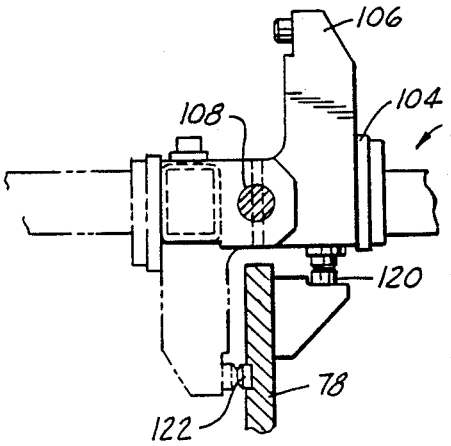
FIG. 8 is an enlarged fragmentary view in the direction of arrows 8—8 of FIG. 7, showing the pick-off finger stops.

FIG. 8 shows in greater detail portions of the pickoff unit 100 of FIGS. 5–7. Specifically, FIG. 8 illustrates the pick-off finger mounting arrangement and stops 120 and 122 which limit the pivotal movement in the withdrawn and extended positions, respectively.

Figure 9:
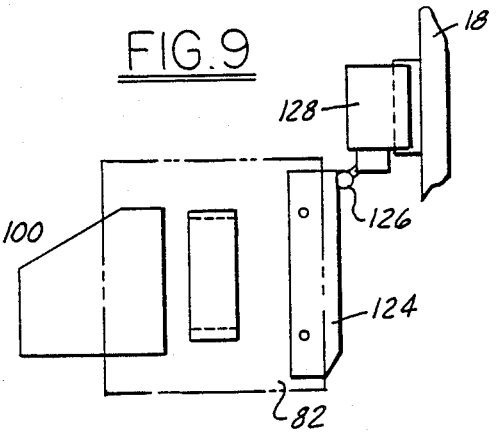
FIG. 9 is an enlarged fragmentary view in the direction of arrows 9—9 of FIG. 7, showing a position sensor for the carriage.
Figure 10:
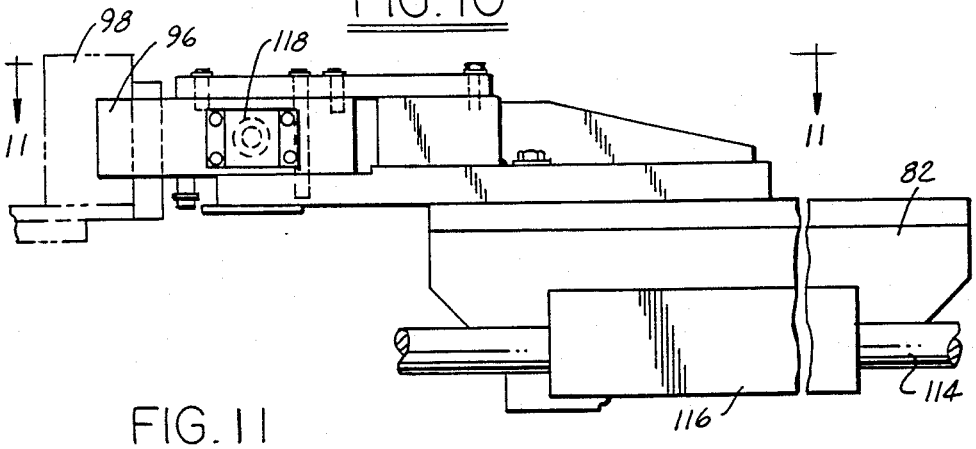
FIG. 10 is an enlarged view of the carriage and gripper jaws, viewed in the direction of arrows 10—10 of FIG. 7.
Figure 11:
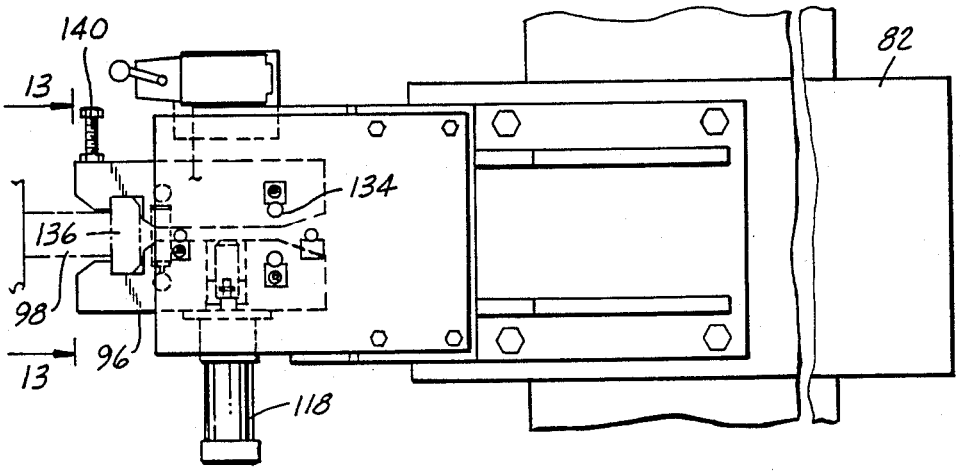
FIG. 11 is a plan view in the direction of arrows 11-11 of FIG. 10.

FIG. 9 illustrates a position-sensing mechanism whereby, when trolley 78 and carriage 82 are in their fully withdrawn or stand-by position, contact plate 124 on the carriage trips actuator 126 of limit switch 128 to indicate such condition to the control mechanism.

Figure 12:
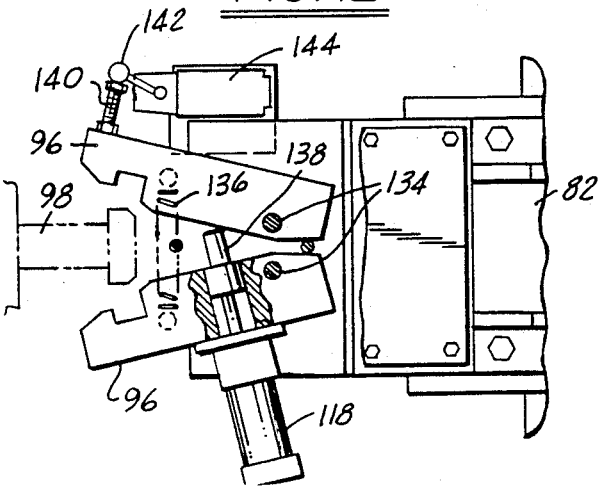
FIG. 12 is an enlarged plan view of the gripper jaws of FIG. 11, shown in their open position.
Figure 13:
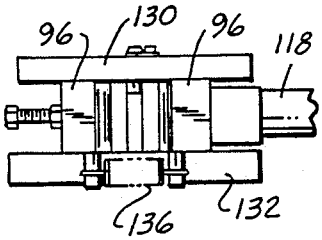
FIG. 13 is a side elevational view of the gripper jaws, viewed in the direction of arrows 13—13 of FIG. 11.

FIGS. 10–13 illustrate details of the gripper jaw assembly by which carriage 82 engages and grips tooling 24 for longitudinal movement toward or away from mainframe 10. Gripper jaws 96 are pivotally mounted between upper and lower plates 130, 132, respectively, on pivot pins 134. The two jaw elements are biased toward each other by tension spring 136. Actuation of hydraulic cylinder 118, which is mounted on one of the jaws, extends cylinder rod 138 into engagement with the opposite jaw member, forcing the jaws apart to their released position, as illustrated in FIG. 12. In such released condition, contact pin 140 on one of the jaw elements engages actuator arm 142 of limit switch 144, thereby indicating that jaws 96 have disengaged from tooling coupling member 98.

Figure 14:
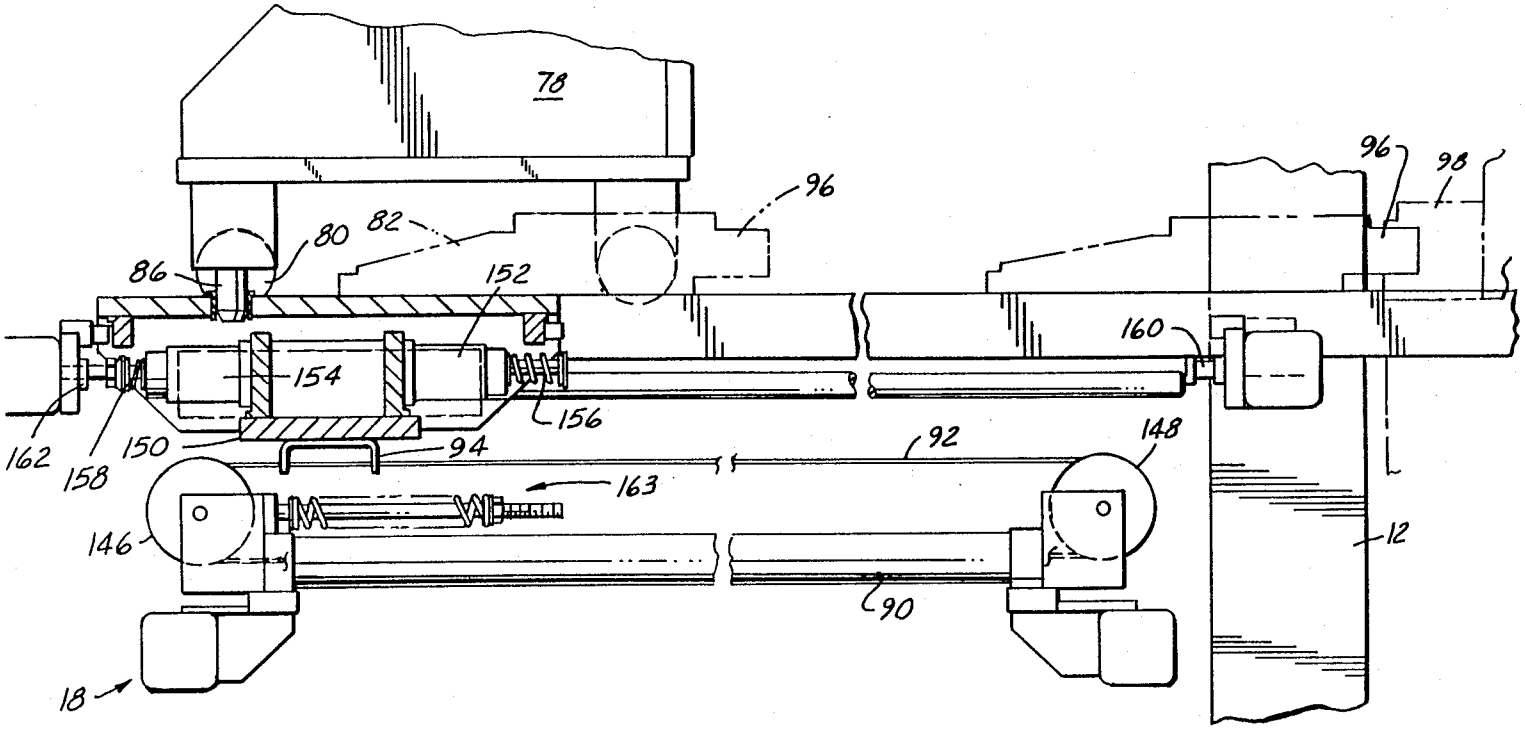
FIG. 14 is an enlarged front view of the carriage transfer mechanism.

FIG. 14 illustrates additional details of the drive mechanism for trolley 78 and carriage 82. As previously explained, transfer cylinder 90 is secured to the tool-loading and pick-off table 18. The transfer cable is looped around a pair of pulleys 146, 148. Cable 92 is fixed to the piston (unillustrated) of transfer cylinder 90, this connection being internal of the cylinder. Thus, actuation of the cylinder causes the cable to move linearly about pulleys 146, 148, carrying with it carriage connector 94 and connector bracket 150. Bracket 150 has a pair of shock absorbers 152, 154 secured to it, these in turn being provided with spring-loaded plungers 156, 158, respectively. These shock absorbers function to cushion the end of the stroke of carriage 82 as it engages adjustable stops 160 or 162 at the respective limits of carriage travel. Cable tensioner 163 is an adjustable biasing means to apply continuous leftward force on pulley 146 to keep cable 92 free of slack.

Figure 15:
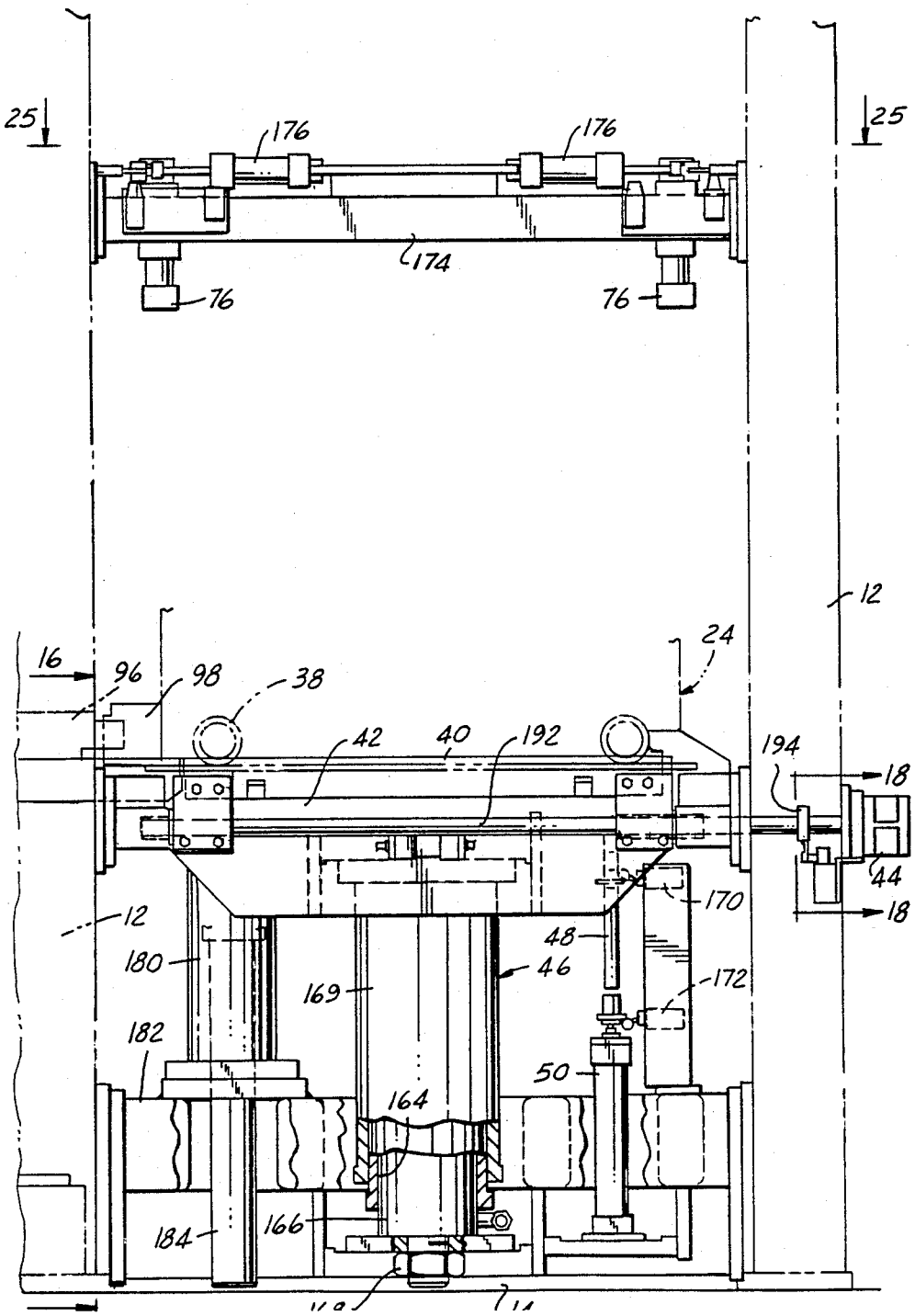
FIG. 15 is a front view of the work table and related structure.

FIG. 15 is an enlarged fragmentary view showing details of the clamping table 42 and clamping cylinder 46. As previously stated, clamping cylinder 46 is of telescoping construction, including an extendable hollow cylinder rod 164 which telescopes over fixed inner cylinder rod 166 which, in turn, is secured to mainframe base 14 by nut 168. Outer cylinder sleeve 169, in turn, telescopes over rod 164 so that the potential stroke of cylinder 46 is almost twice the stroke of a conventional cylinder. The telescoping construction of cylinder 46 permits a more compact assembly, without the need for a pit beneath the floor to accommodate the required stroke of a conventional cylinder. A suitable telescoping cylinder for this purpose is manufactured by Precision Hydraulics & Engineering, Inc., of Signal Hill, California. The vertical position of lower ejector pin actuators 48 is sensed by upper and lower limit switches 170, 172, respectively, which are tripped by flanges on lower ejector pin actuators 48. Ejector pin actuators hang or are spring-biased to their downward position illustrated in FIGS. 15 and 16, but they are adapted to be displaced upwardly when cylinders 50 are extended. As will be understood by those skilled in the art, bottom stool 26 is provided with a conventional ejector plate mechanism (not illustrated) adapted to be engaged and actuated by ejector pin actuators 48 so that ejector pins 390 (see FIG. 53) may enter aligned holes in drag 28 to eject the completed core from the drag cavity.

The upper portion of FIG. 15 shows a mainframe crossmember 174 on which cope hangers 76 are mounted for pivotal movement under the influence of hydraulic cylinders 176. Cylinders 176 cause hangers 76 to swing from a stand-by position, which provides clearance for vertical passage of tooling 24, and an extended position in which they support the upper core box or cope. A pair of limit switches 178 sense the two pivotal positions of cope hanger 76.

Figure 16:
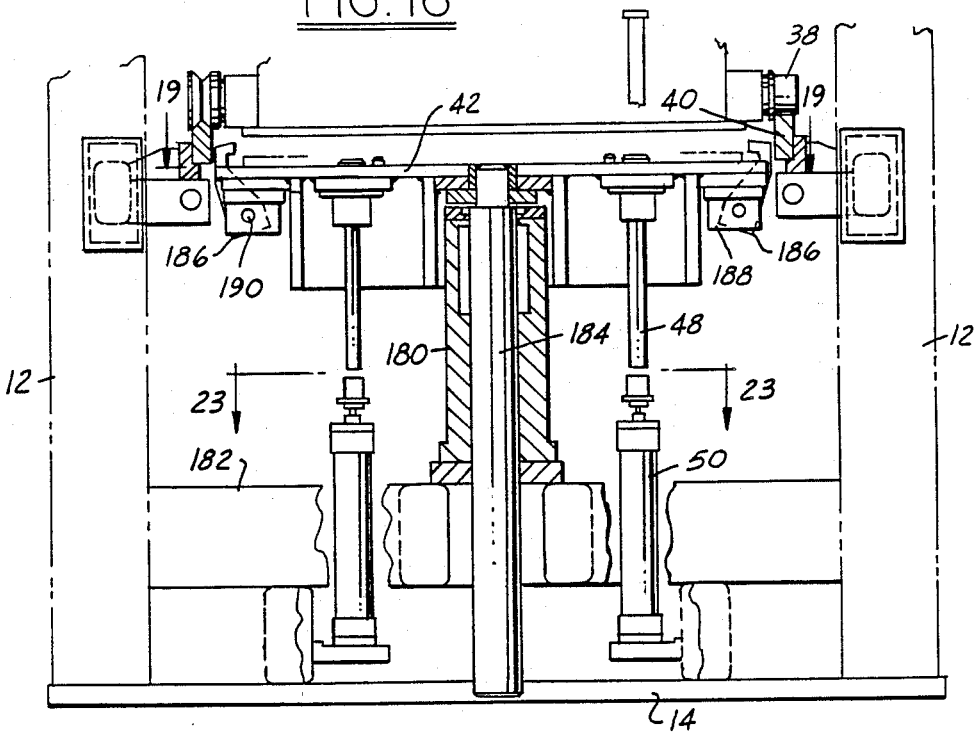
FIG. 16 is a side view of the work table, viewed in the direction of arrows 16—16 of FIG. 15.

FIG. 16 illustrates additional details of the clamping table and related structure. Guidance and stabilization of clamping table 42 throughout its vertical movement is provided by guide rod bushings 180 which are secured to frame crossmember 182. These bushings receive guide rods 184 which are secured to the underside of clamping table 42. Also shown in FIG. 16 are two of the four clamping units 186 which are pivotally secured to brackets 188 and caused to pivot by shafts 190. As will be further explained below, clamping units 186 function to clamp tooling 24 to clamping table 42.

Figure 17:
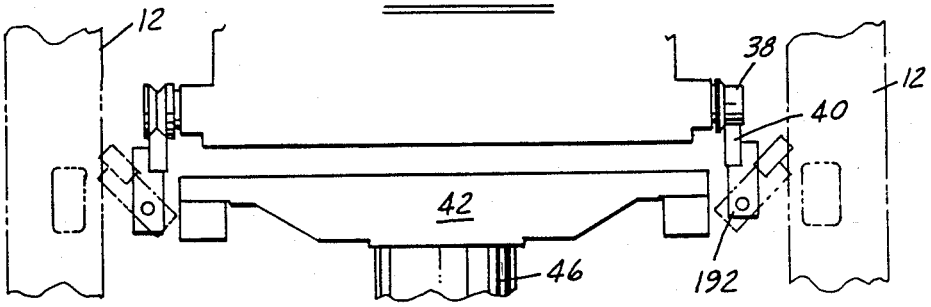
FIG. 17 is a fragmentary view, similar to FIG. 16, showing the alternative positions of the rails.
Figure 18:
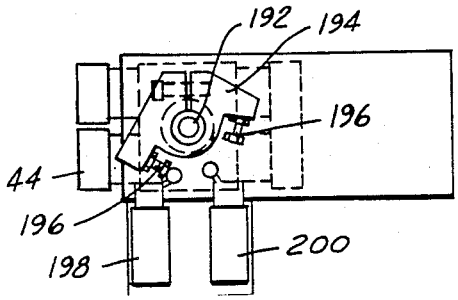
FIG. 18 is a side view of the rail actuator mechanism, viewed in the direction of arrows 18—18 of FIG. 15.

Referring now to FIGS. 17 and 18, there is illustrated the mechanism for causing pivotal rails 40 to swing out of the path of the tooling. The rails are mounted for pivotal movement with pivot shafts 192. Hydraulic rotary actuators 44 cause rotational movement of shafts 192 by means of a rack and pinion arrangement which is not illustrated but which may be similar to that illustrated in FIG. 41. Brackets 194 are similarly clamped to pivot shafts 192 so that actuation causes simultaneous pivotal movement of brackets 194, shaft 192 and rails 40. Contact screws 196 are mounted on brackets 194 for engagement with rail position-indicating limit switches 198 and 200.

Figure 19:
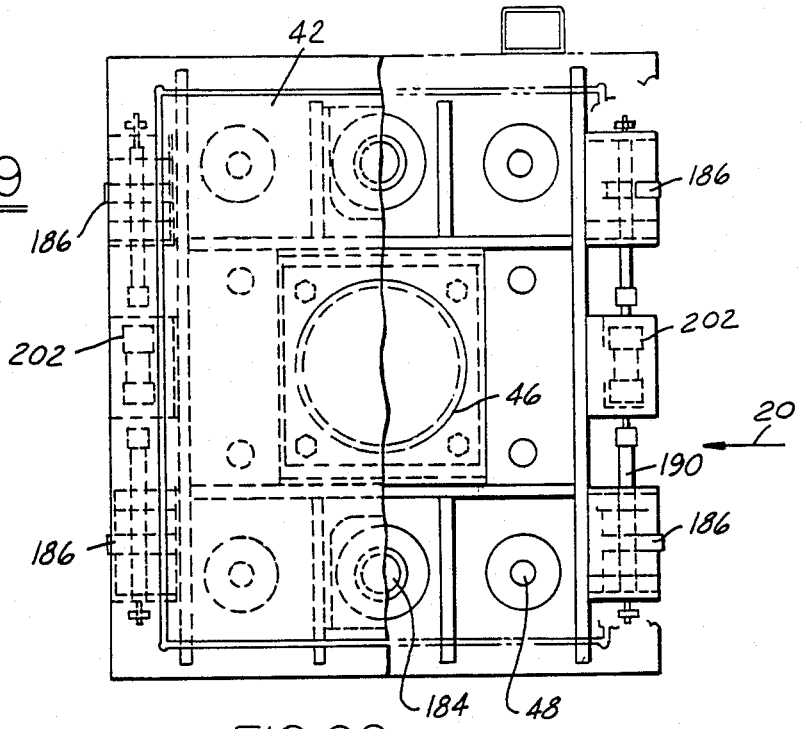
FIG. 19 is a plan view, partly broken away, of the work table, viewed in the direction of arrows 19—19 of FIG. 16.
Figure 20:
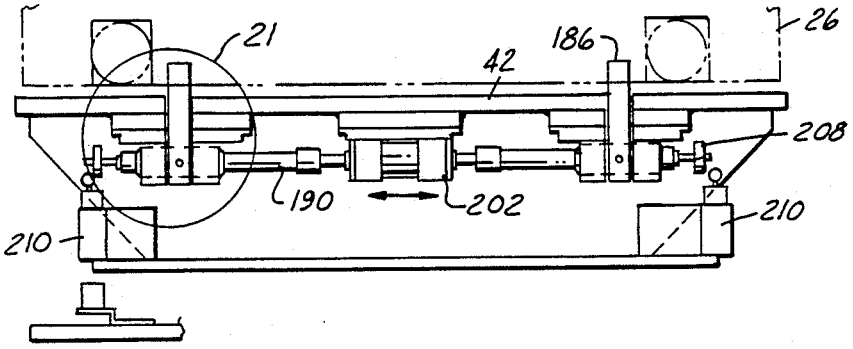
FIG. 20 is a right side view of the tooling clamping mechanism, viewed in the direction of arrow 20 of FIG. 19.
Figure 22:
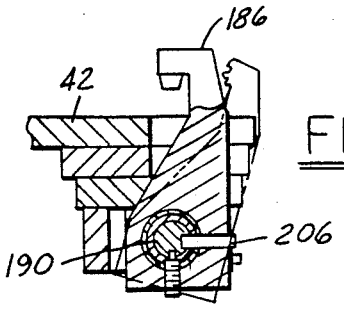
FIG. 22 is a sectional view in the direction of arrows 22—22 of FIG. 21.
Figure 21:
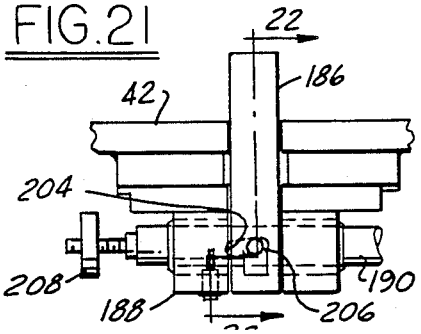
FIG. 21 is an enlarged view of the clamping mechanism shown within circle 21 of FIG. 20.

FIGS. 19–22 show the clamping mechanism for clamping tooling 24 to table 42. As shown in FIGS. 19–20, cylinders 202 have shaft extensions 190 which simultaneously stroke outwardly upon actuation of the cylinder. Each shaft has a camming slot 204 which is skewed relative to the shaft axis, as seen in FIG. 21. Follower pin 206 in clamp 186 rides in slot 204, whereby longitudinal stroking of shaft 190 by cylinder 202 causes the sides of slot 204 to cam follower pin 206 so as to pivot clamp 186 into or out of its clamping position. In the solid line clamping position shown in FIG. 22, clamp 186 engages a flange on bottom stool 26 to retain tooling 24 in position on table 42. Shaft extensions 190 carry actuators 208 which trip limit switches 210 to indicate the condition of clamps 186.

Figure 23:
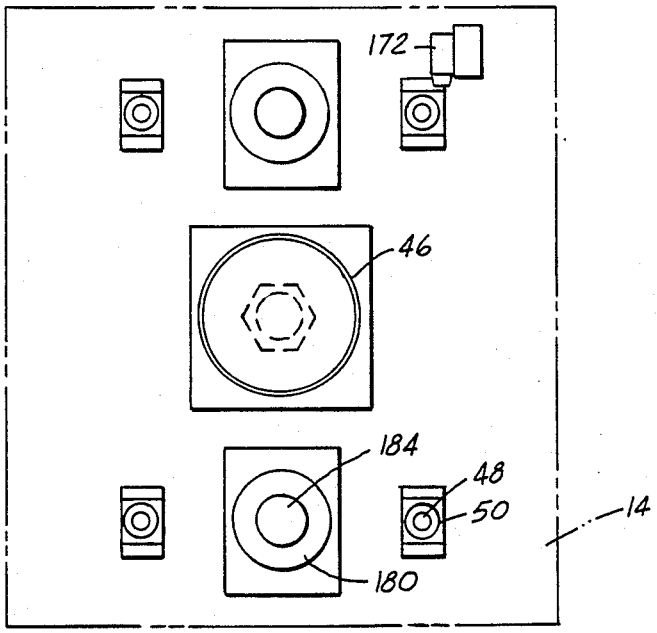
FIG. 23 is a plan view of the work table supporting structure, viewed in the direction of arrows 23—23 of FIG. 16.

FIG. 23 is a sectional view of the previously described structure beneath clamping table 42, showing table clamp cylinder 46, guide rods 184, lower ejector pin actuators 48 and a representative lower limit switch 172.

Figure 24:
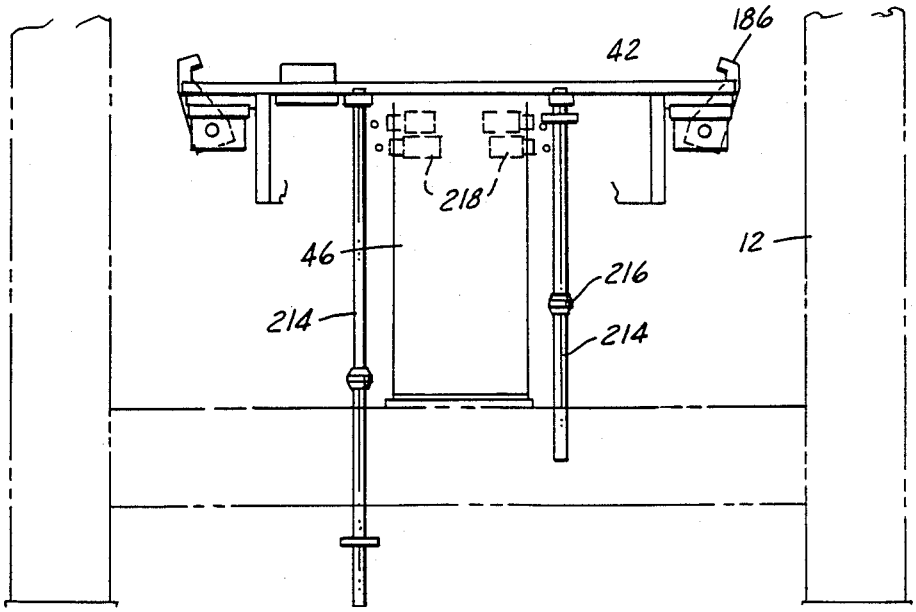
FIG. 24 is a fragmentary view, similar to FIG. 16, showing the table position-indicating means.
Figure 25:
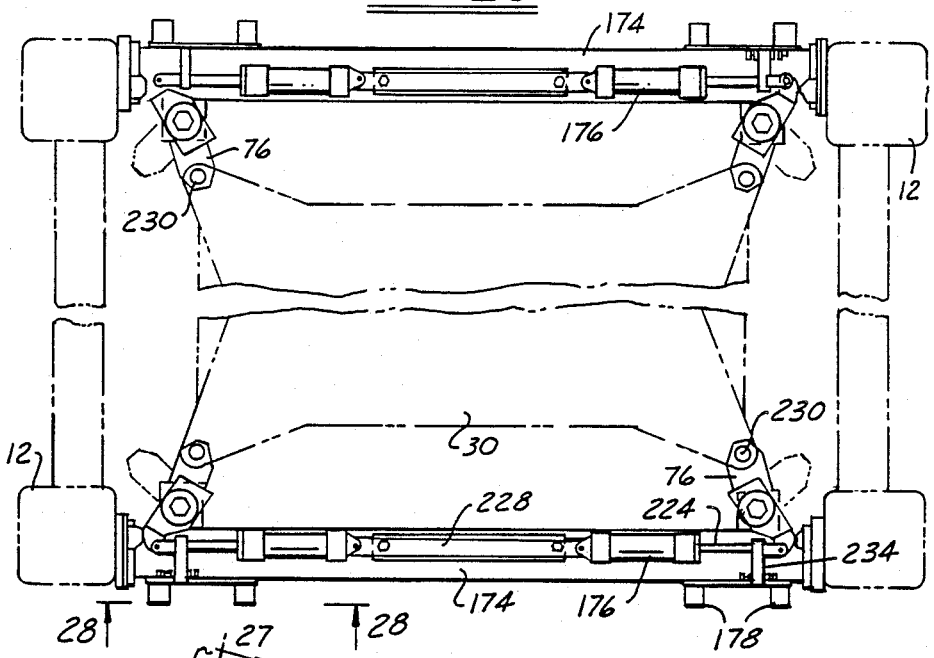
FIG. 25 is a plan view of the cope hanger mechanism, viewed in the direction of arrows 25—25 of FIG. 15.
Figure 26:
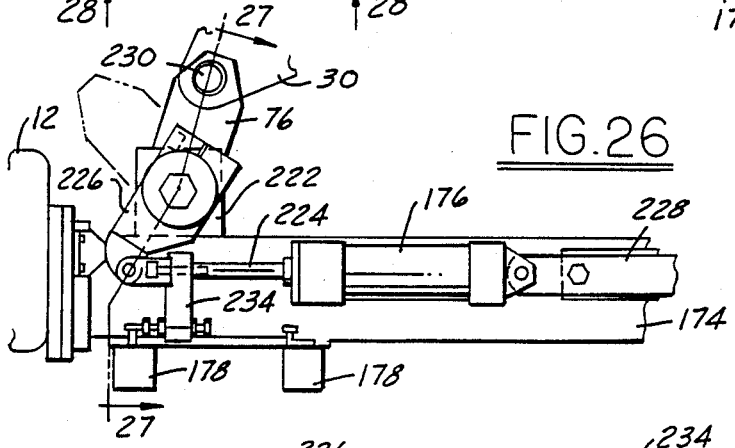
FIG. 26 is an enlarged plan view detail of one of the cope hangers of FIG. 25.

FIG. 24 illustrates the mechanism for sensing the vertical elevation of clamping table 42. A pair of vertical rods 214 extend downwardly from the underside of the table, each rod having an enlarged cam portion 216 adapted to trip limit switches 218 to thereby indicate when the table has reached a predetermined position.

Figure 27:
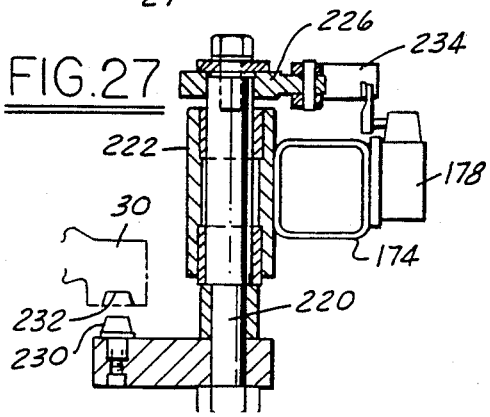
FIG. 27 is a sectional elevation viewed in the direction of arrows 27—27 of FIG. 26.
Figure 28:
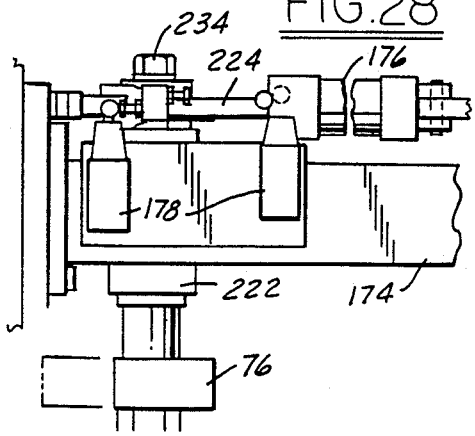
FIG. 28 is a front view of the cope hanger of FIG. 27.

FIGS. 25–28 illustrate, in further detail, the cope hanger construction previously described in relation to FIG. 15. Cope 30 is shown in phantom in the plan view of FIG. 25 and in the fragmentary cross-sectional elevation of FIG. 27. Each of cope hangers 76 is mounted for pivotal movement with a pivot shaft 220 which is rotatably received within bracket 222 secured to frame crossmember 174. Cylinder rod 224 of cope hanger actuating cylinder 176 is connected to an actuating lever 226 which is secured to pivot shaft 220 for rotation therewith. Thus, linear movement of cylinder rod 224 causes pivotal movement of lever 226, shaft 220 and cope hanger 76. Brackets 228 provide support for the opposite end of each of hydraulic cylinders 176. As best shown in FIG. 27, each of cope hangers 76 has an upwardly tapering cope locating pin 230 which is adapted to seat in a downwardly opening socket 232 at each of the four corners of cope 30. In this manner, cope hangers 76 function to both locate and support cope 30 during the appropriate portion of the cycle. A limit switch actuator 234 on each of cylinder rods 224 functions to trip the appropriate limit switch 178 to indicate the condition and position of cope hangers 76.

Figure 29:
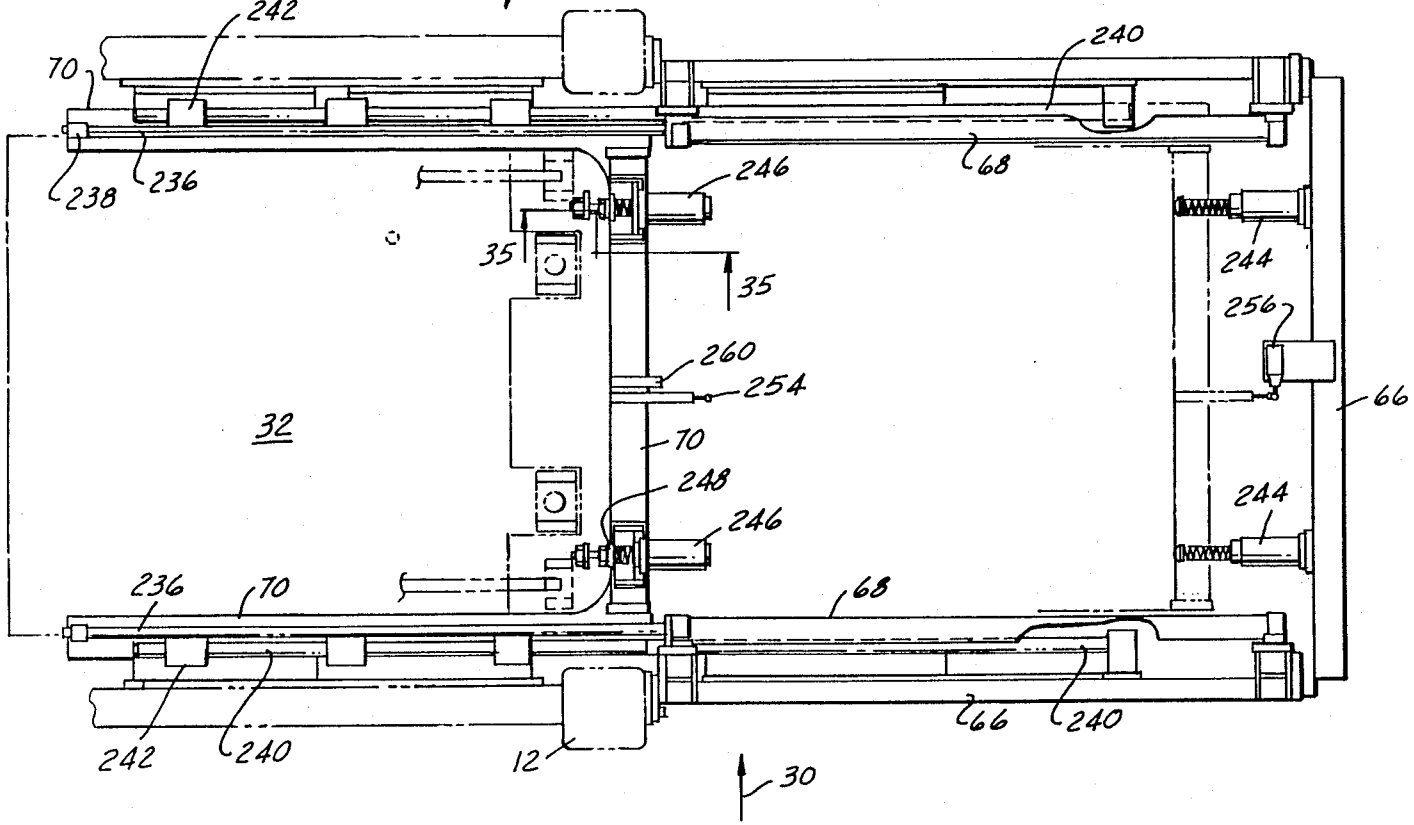
FIG. 29 is a plan view of the gassing manifold transfer mechanism, viewed in the direction of arrows 29—29 of FIG. 1.
Figure 30:
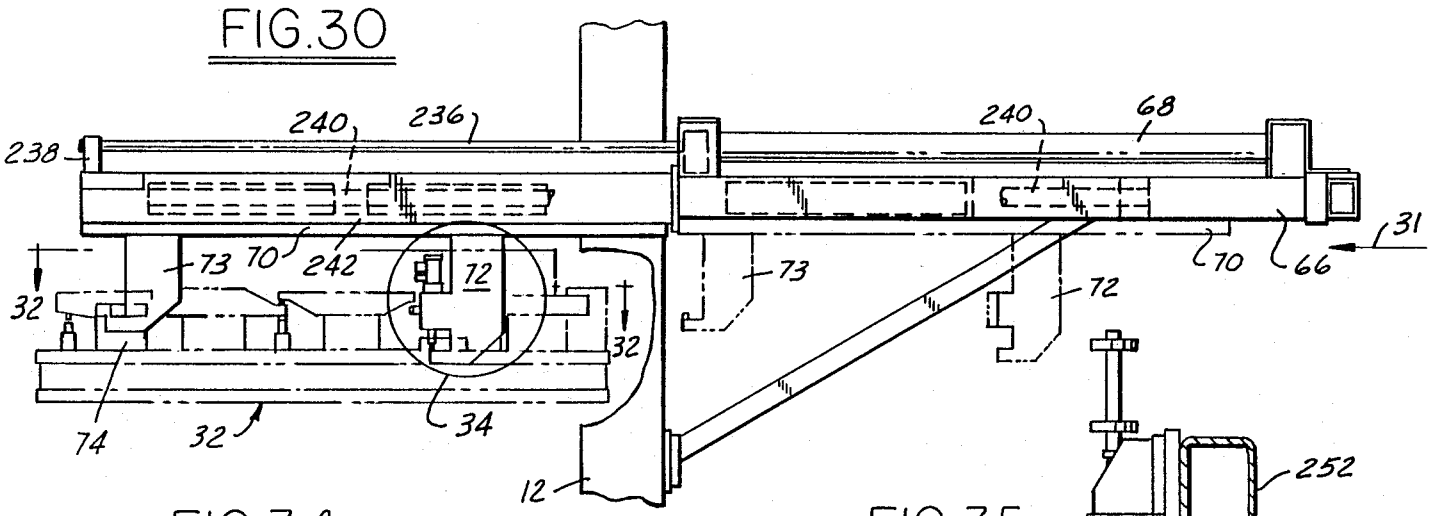
FIG. 30 is a front view of the apparatus of FIG. 29.

FIGS. 29 and 30 show further details of the gassing manifold and ejector plate transfer mechanism generally shown in FIG. 1. As previously explained, a gassing manifold transfer support frame 66 is secured to one end of mainframe 10. Hydraulic cylinder 68, which functions to traverse gassing manifold transfer carriage 70 between its active and stand-by positions, has a cylinder rod 236 which is secured to a bracket 238 on carriage 70. In FIG. 30, carriage 70 is shown in its operative position at the left side of the figure, whereas the stand-by position is shown in phantom at the right side of the figure. Carriage 70 is supported during its traverse by means of guide rods 240, which are mounted on mainframe 10 and gassing manifold transfer support frame 66, and by guide rod bushings 242 on carriage 70 (see FIG. 31 for further illustration of the guide rods and bushings).

As shown in FIG. 29, a pair of shock absorbers 244 is mounted on frame 66 to cushion the end of the stroke of gassing manifold transfer carriage 70 as it reaches the end of its stroke toward its stand-by position. Similarly, another pair of shock absorbers 246 is mounted on carriage 70 itself (see FIGS. 29 and 35). When the carriage reaches the end of its stroke toward its operative position, the spring-loaded plungers of shock absorbers 246 engage stop members 248 which are carried by brackets 250 mounted on mainframe member 252.

Figure 31:
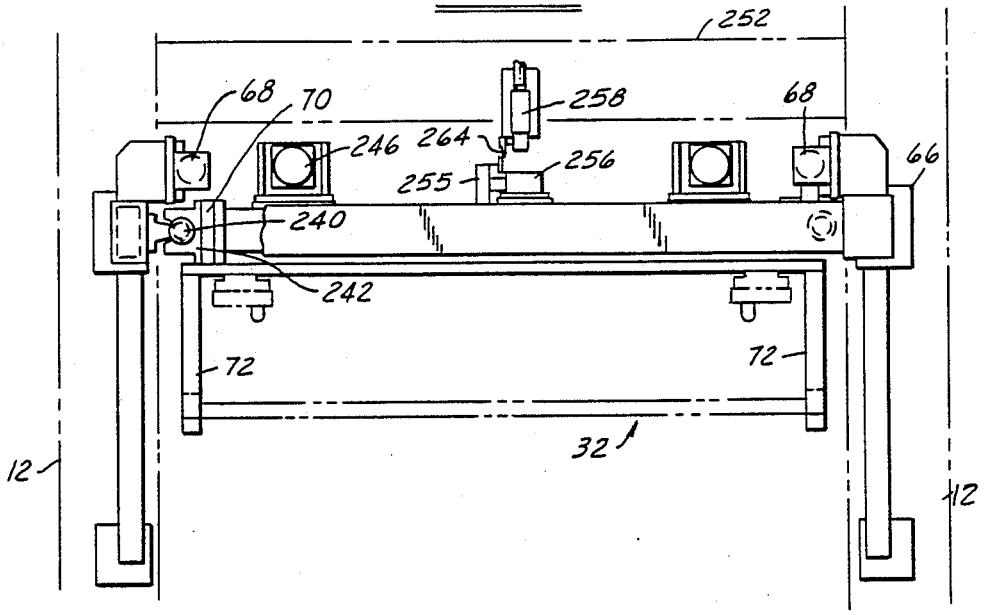
FIG. 31 is a right side view in the direction of arrow 31 of FIG. 30.

As best shown in FIGS. 29 and 31, limit switches provide a signal when carriage 70 has reached its respective positions. Specifically, an actuator 254 on carriage 70 trips limit switch 256 on support frame 66 when the carriage reaches its stand-by position, whereas limit switch 258 on mainframe member 252 is positioned to be tripped by actuator 260 on carriage 70 when the carriage reaches its operative position.

FIGS. 30 and 31 further show two pairs of gassing manifold hanger brackets 72, 73 which are mounted on carriage 70 and which engage retainer brackets 74 on gassing manifold and ejector plate 32, as will be further described below.

Figure 32:
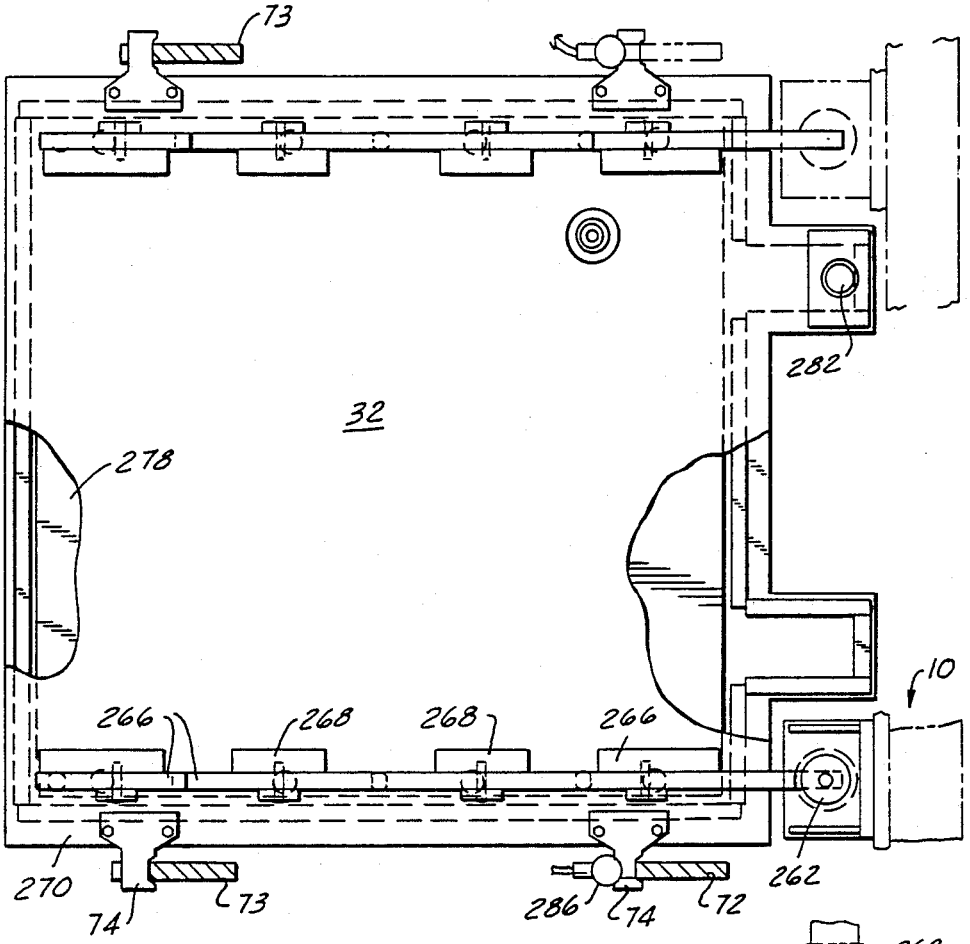
FIG. 32 is a plan view, partly broken away, of the gassing manifold, viewed in the direction of arrows 32—32 of FIG. 30.
Figure 33:
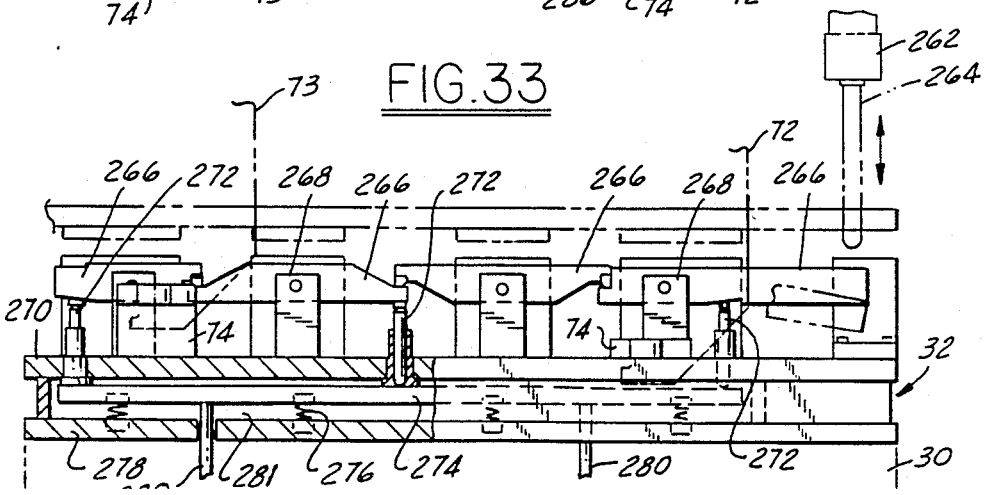
FIG. 33 is a front view, partly broken away, of the gassing manifold and top ejector plate of FIG. 32.

FIGS. 32 and 33 illustrate the actuating mechanism for the upper ejector pins. A pair of hydraulic cylinders 262 is secured to a portion of mainframe 10. Output rods 264 of the cylinders extend downwardly into selective engagement with the first of the series of interengaging rocker arms 266, each of which is pivotally mounted on a bracket 268 secured to top plate 270 of gassing manifold and ejector plate 32.

As best shown in FIG. 33, downward extension of cylinder rod 264 brings it into engagement with the righthand rocker arm 266, causing such rocker arm to pivot clockwise and to force the righthand pushrod 272 downward through an opening in top plate 270 and into engagement with ejector pin plate 274. This rocking movement of righthand rocker arm 266 causes similar rocking action by each of the other interengaged rocker arms, forcing the other pushrods downward into engagement with ejector pin plate 274. Plate 274 is normally biased upwardly by compression springs 276 held between plate 274 and gassing manifold bottom plate 278. A plurality of ejector pins 280 extend downwardly from their connection to ejector pin plate 274 and through aligned openings provided in upper core box or cope 30 located immediately beneath gassing manifold 32.

A plurality of parting line pins (not illustrated) are secured to the underside of ejector pin plate 274 and extend downwardly into engagement with the top of drag 28 when the mold boxes are closed and in raised position against gassing manifold bottom plate 278. These parting line pins prevent downward deflection of ejector pin plate 274 until the mold boxes have separated from each other, thereby preventing damaging premature pressure of ejector pins 280 on the newly-formed core within the mold cavity.

Top and bottom plates 270, 278, respectively, define a manifold chamber 281. The access openings for push-rods 272 are provided with guide bushings and suitable sealing means to substantially prevent gas leakage therethrough.

FIG. 32 also illustrates one of a pair of gas pipe connections 282 which supply catalyzing gas to the interior of gassing manifold 32, as will be further discussed below.

Figure 34:
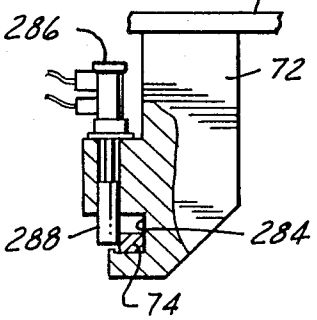
FIG. 34 is an enlarged view of the clamping mechanism within the circle 34 of FIG. 30.

FIG. 34 shows an enlarged detail of gassing manifold hanger bracket 72. Bracket 72 has a cut-out portion 284 which is adapted to receive a portion retainer bracket 74 on gassing manifold and ejector plate 32. When these elements have engaged, hydraulic cylinder 286 is actuated to extend cylinder rod 288 to clamp gassing manifold retainer bracket 74 within hanger bracket 72. Similarly, retraction of cylinder rod 288 permits separation of gassing manifold and ejector plate 32 from hanger bracket 72.

Figure 35:
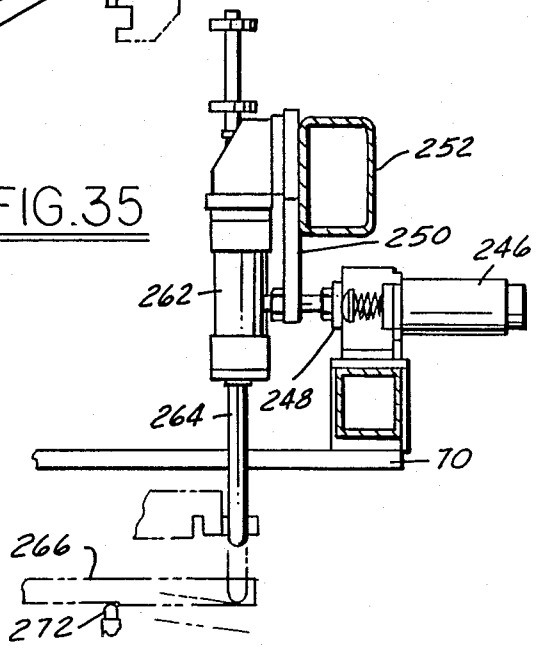
FIG. 35 is a front view of the top ejector pin actuator, viewed in the direction of arrows 35—35 of FIG. 29.

FIG. 35, a portion of which has previously been described, shows the manner in which upper ejector pin hydraulic cylinder 262 is secured to mainframe member 252.

Figure 37:
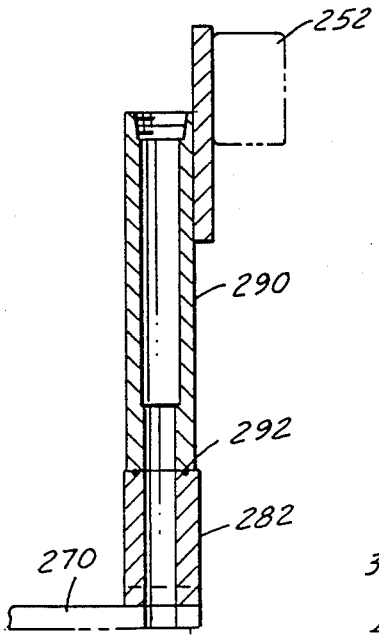
FIG. 37 is a sectional elevation viewed in the direction of arrows 37—37 of FIG. 36.
Figure 36:
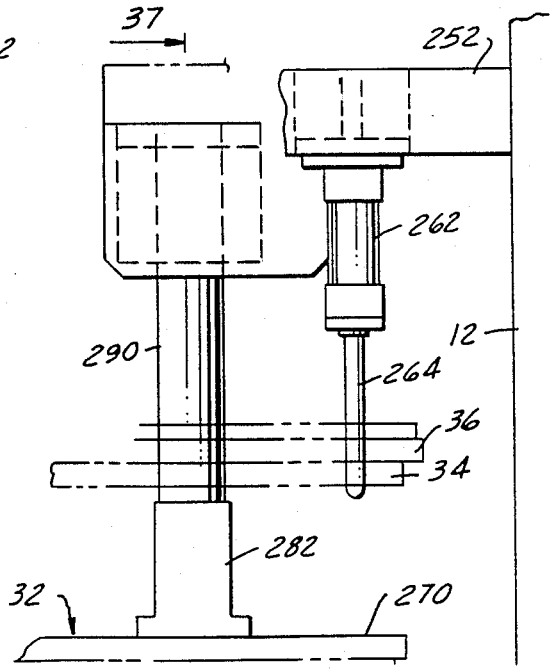
FIG. 36 is a front view of the gas connections for the gassing manifold.

FIGS. 36 and 37, in addition to showing the previously described hydraulic chamber 262 which actuates the upper ejector pins, further show the connections for supplying catalyzing gas to gassing manifold and ejector plate 32. As also illustrated in FIG. 32, gas pipe connection 282 is fixed to top plate 270 of the gassing manifold and ejector plate 32. At the proper point in the operating cycle, the upper opening of connection 282 is moved upwardly into abutting and sealed connection with a fixed gas supply pipe 290 which is secured to mainframe crossmember 252. As shown in FIG. 37, an O-ring 286 is provided to seal this abutting connection. The upper end of supply pipe 290 is connected to a source of catalyzing gas (unillustrated). At the proper time in the operating cycle, gas is caused to flow through pipe 290 and connection 282 into gassing manifold chamber 281 (see FIG. 33) and from such chamber through the clearance gaps surrounding ejector pins 280 in bottom plate 278 and into aligned channels in cope 30 leading to the formed part within the mold box cavity.

Figure 38:
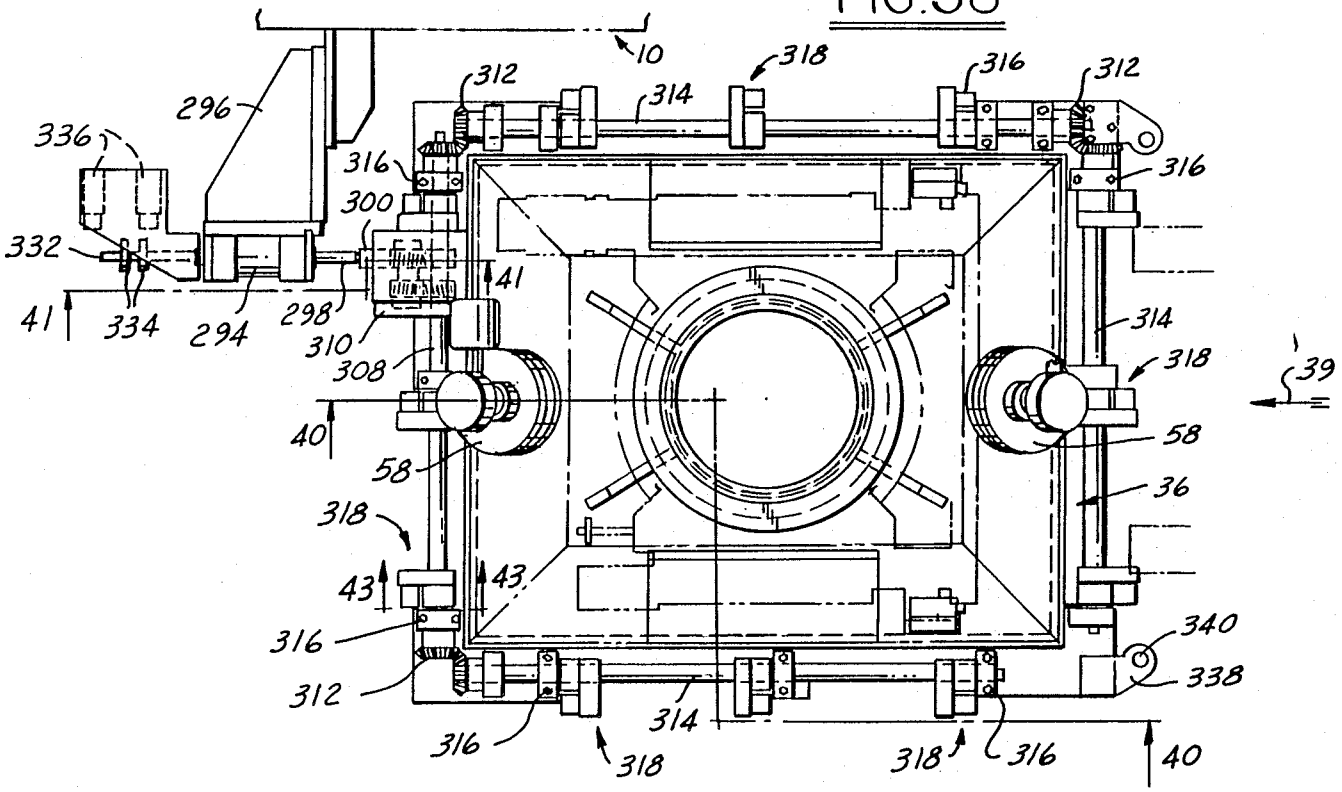
FIG. 38 is a plan view of the sand magazine, viewed in the direction of arrows 38—38 of FIG. 1.

FIG. 38 shows additional details of sand magazine 36 and the clamping mechanism by which blow plate 34 is clamped to the lower side of the sand magazine. Additional details of the clamping mechanism are shown in FIGS. 41–44, which should be referred to in connection with the following description.

The blow plate clamping mechanism includes a pair of clamping cylinders 294 which are secured to main frame 10 by means of bracket 296. Each of cylinders 294 has a cylinder rod 298 which abuts the end of a cooperating rack gear 300. Both rack gears engage a pinion gear 302 which rotates in conjunction with adjacent pinion gear 304 on the same shaft. Gear 304 in turn meshes with spur gear 306 which is keyed to shaft 308. Rach gears 300, pinion gears 302 and 304, spur gear 306 and shaft 308 are all mounted within gear housing 310 secured to sand magazine 36. At each of end of shaft 308 there is a bevel gear set 312 which provides driving engagement with similar bevel gears on three additional clamping shafts 314.

Thus, shaft 308 and the three additional shafts 314 are arrayed around four sides of sand magazine 36 and are rotatably mounted in brackets 316 secured to the sand magazine.

FIGS. 43 and 44 illustrate the manner in which a typical clamping unit 318 clamps blow plate 34 to sand magazine 36. Each clamping unit comprises a clamping arm 320 and an actuating arm 322, each keyed to shaft 308. A lateral projection 324 on arm 322 overlaps arm 320, and a compression spring 326 retained between these overlapping portions continuously biases the arms away from each other. While actuating arm 322 is keyed to shaft 308 for direct pivotal movement therewith, it can be seen in FIG. 43 that key 328 for clamping arm 320 is placed in an oversized slot 330 in arm 320. This arrangement permits a limited amount of lost motion between the rotation of shaft 310 and the pivoting movement of clamping arm 320. Such lost motion feature avoids overstressing of the clamping and clamped elements and eliminates the need for close control on tolerances on all of the clamping members around the four sides of the blow plate, as would otherwise be necessary to assure simultaneous and even clamping pressure at all clamping locations. Thus, once blow plate 34 is securely clamped against sand magazine 36 at a particular clamping unit, further rotation of shaft 310 and actuating arm 322 is still possible, without accompanying rotation of clamping arm 320. Nevertheless, firm clamping pressure will continue to be exerted because of compression spring 326.

Figure 41:
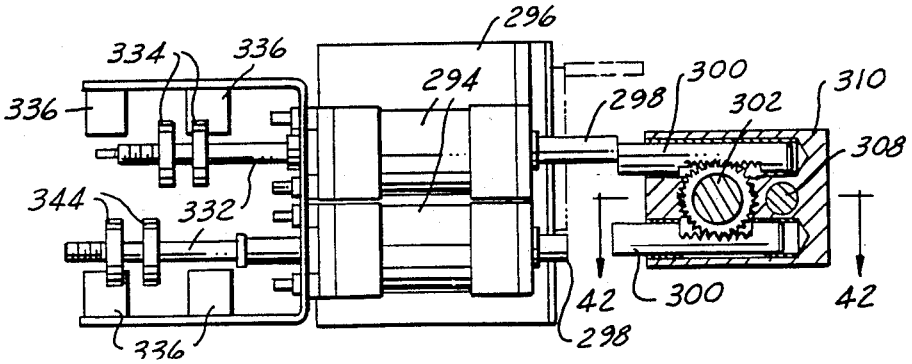
FIG. 41 is a front view, partly in section, of the blow plate clamping actuator mechanism, viewed in the direction of arrows 41—41 of FIG. 38.

FIGS. 38 and 41 also illustrate a limit switch arrangement which signals the condition of the blow plate clamping system. Each of hydraulic cylinders 294 has a cylinder rod extension 332 provided with a pair of limit switch actuators 334 which engage one or the other of a pair of limit switches 336. Thus, these limit switches generate a signal which indicates whether the clamping mechanism is in either its clamped or released condition.

Figure 40:
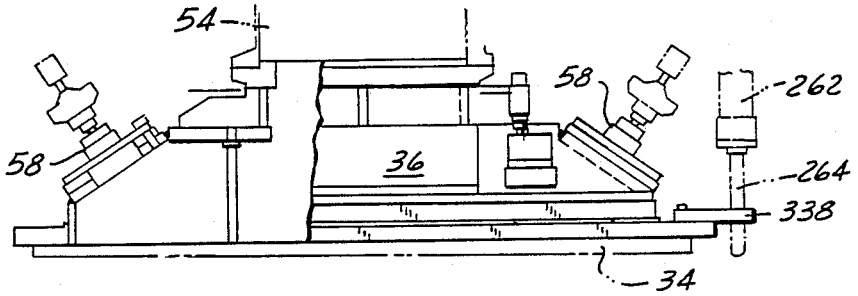
FIG. 40 is a front view, partly in section, of the sand magazine of FIG. 38.

FIGS. 33 and 40 also illustrate a pair of guide brackets 338 secured to the corners of sand magazine 36. These brackets are provided with guide holes 340 through which cylinder rods 264 of the upper ejector pin actuating mechanism project (see also FIGS. 35–36).

Figure 39:
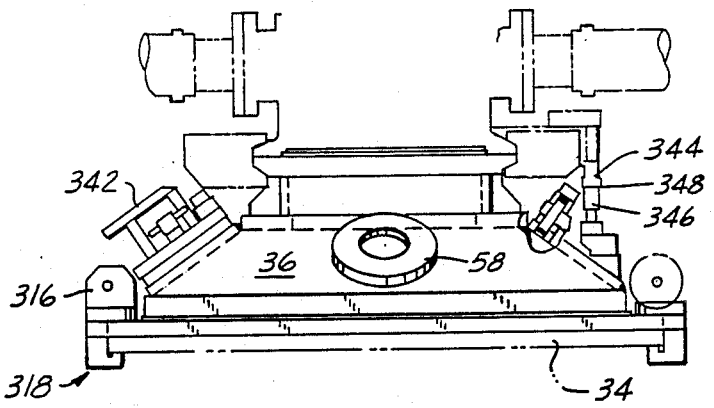
FIG. 39 is a right side view in the direction of arrow 39 of FIG. 38.

FIG. 39 also shows a handle and locking device 342 for a sand magazine clean-out door. Also shown is a pneumatic line 344 fixed to mainframe 10 and adapted to connect with connector line 346 on sand magazine 36 at coupling joint 348 when brought into abutting engagement upon upward movement of the sand magazine. This pressurized air is used to actuate exhaust vent valves 58 between their open position during sand charging and their closed position during blowing.

Figure 45:
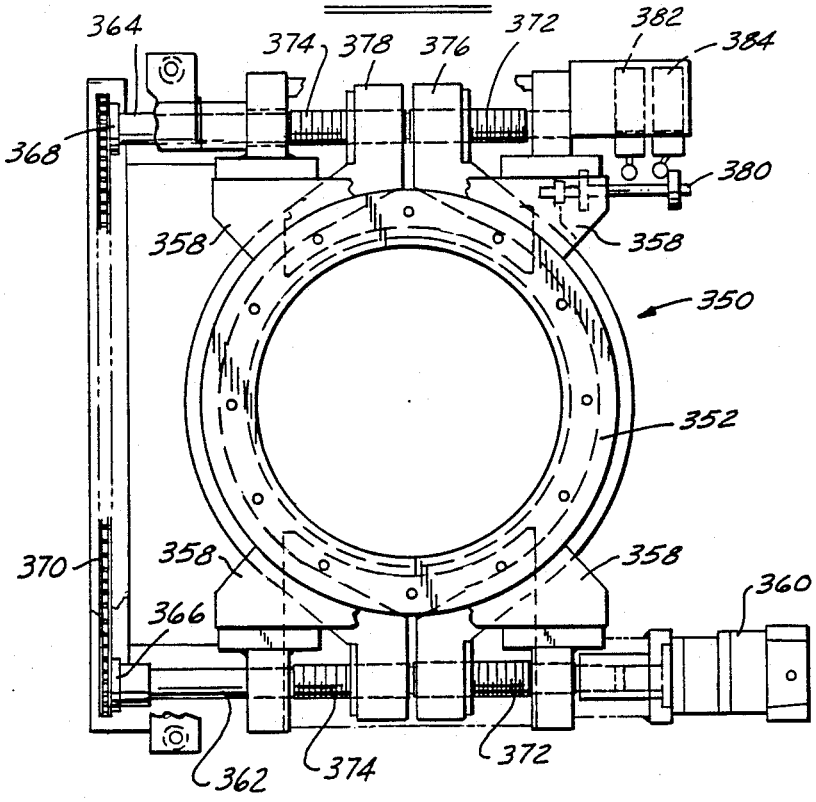
FIG. 45 is a plan view of the blow body clamping assembly.
Figure 46:
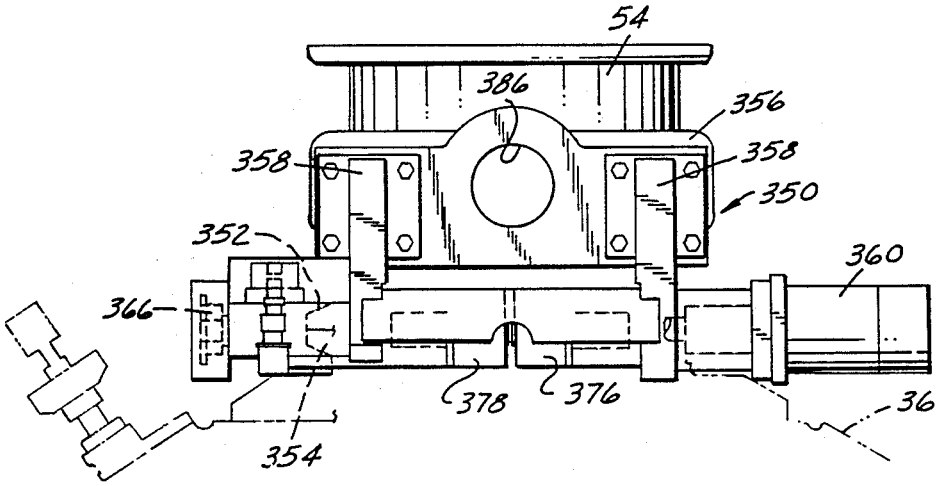
FIG. 46 is a front view of the clamping assembly of FIG. 45.

FIGS. 45 and 46 illustrate blow body clamping assembly 350 which forms a part of blow sleeve 54 and which removably clamps blow sleeve 352 to sand magazine flange 354. Assembly 350 includes annular blow body 356 from which extend four brackets 358 which in turn support reversible hydraulic drive motor 360 and rotatably mounted threaded drive shaft 362. Rotation of drive shaft 362 causes simultaneous rotation of driven shaft 364 by means of sprockets 366, 368 and connecting drive chain 370. Shafts 362 and 364 are each provided with oppositely threaded segments so that shaft rotation causes the two opposed C-clamp rings 376, 378 to move toward or away from each other, depending upon the direction of rotation.

Actuator 380 on C-clamp ring 376 is positioned to trip limit switches 382, 384 to thereby generate signals responsive to the clamped or released condition of clamping assembly 350. Air inlet 386 provides a connection point for blowing air from supply tank 62 and blow control valve 64 (see FIG. 2).

Figure 47:
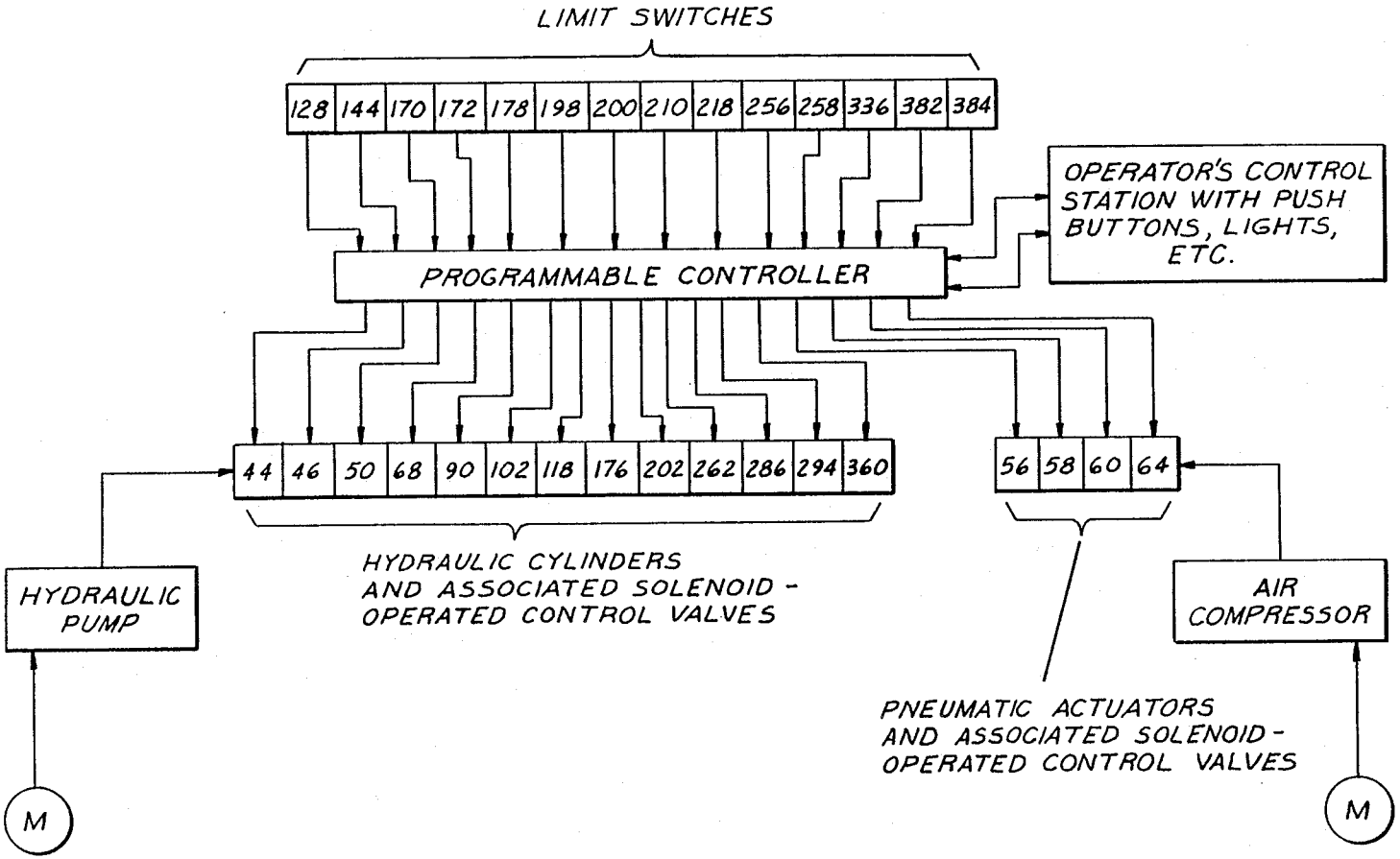
FIG. 47 is a schematic diagram of the control system.

FIG. 47 is a simplified schematic block diagram showing a control system for operating the foundry machine of the present invention. It is contemplated that the operating cycle would be controlled by a suitable programmable controller, such as manufactured by Allen-Bradley of Milwaukee, Wisconsin.

SEQUENCE OF OPERATION

In connection with the description of the operation of the foundry machine throughout its cycle, reference should first be made to FIG. 1, and then to the simplified views of FIGS. 48–53. FIG. 1 shows all of the tooling 24 initially on tool loading table 18. The tooling includes sand magazine 36, blow plate 34, gassing manifold and ejector plate 32, cope 30, drag 28 and bottom stool 26. These elements are merely stacked on each other by appropriate nesting or other formations. They are not clamped together. The arms of core pick-off unit 100 are in their illustrated retracted position. Pivotable rails 40 on mainframe 10 are in their normal vertically oriented operative position, as illustrated in FIG. 17.

Transfer cylinder 90 is then actuated to bring gripper jaws 96 of carriage 82 into engagement with tooling coupling 98 on bottom stool 26. Next, hydraulic cylinder 118 is actuated to clamp jaws 96 onto coupling 98, and the tooling may then be transferred from tool loading and pick-off table 18 onto the aligned pivotable rails 40 of mainframe 10 (see FIGS. 4–6 and 10–14). That is the condition of the apparatus shown in solid lines in FIG. 48.

Figure 48:
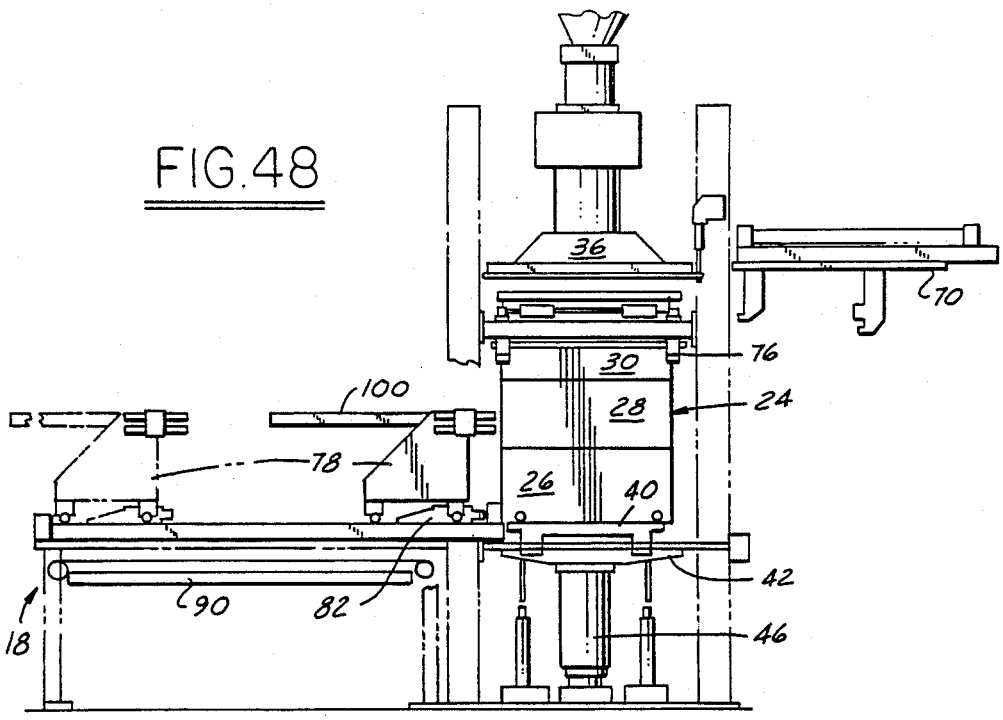
FIGS. 48–53 are simplified front views showing successive stages of the operating cycle of the apparatus.

Next, gripper jaws 96 are released from tooling coupling 98 so that trolley 78 and carriage 82 may be returned to their stand-by position illustrated in phantom in FIG. 48. Table clamp cylinder 46 is then actuated to lift tooling 24 off of pivotable rails 40 and to bring tooling 24 up into engagement with blow sleeve 54. With the tooling lifted off rails 40, rotary actuator 44 is actuated to swing rails 40 outwardly to provide clearance for the table to be subsequently lowered below its starting position (see FIGS. 15–18). As clamping table 42 moves upwardly, hydraulic cylinders 202 are actuated to clamp bottom stool 26 to the table by means of clamping units 186 (see FIGS. 19–22). During this part of the cycle, cope hangers 76 are in their withdrawn position (shown in phantom in FIG. 25), to provide clearance for the vertically moving tooling. Sand magazine 36 is the clamped to blow sleeve 54 by clamping assembly 350 (see FIGS. 45–46), and blow plate 34 is clamped to sand magazine 36 by clamping units 318 (see FIGS. 38–44).

Figure 49:
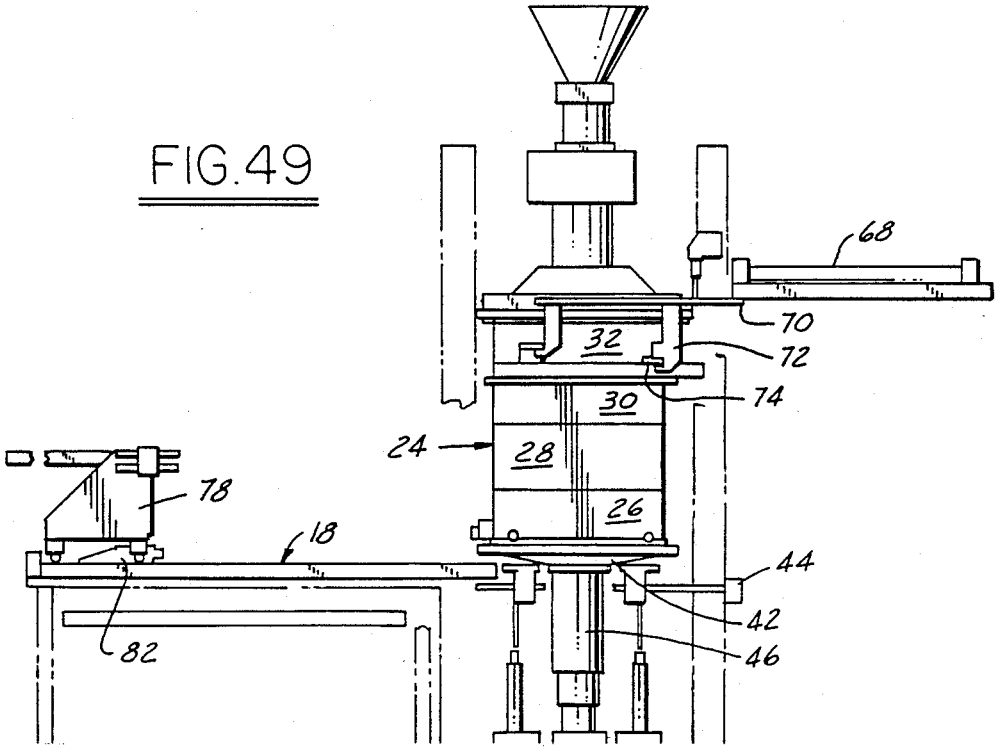

As the next step in the cycle, gassing manifold transfer carriage 70 is brought from its stand-by position shown in FIG. 48 to its clamping position shown in FIG. 49 by means of hydraulic cylinder 68. Hydraulic cylinder 386 is actuated to clamp hanger bracket 72 to retainer bracket 74 on gassing manifold 32 (see FIGS. 29 to 34). Next, cope hangers 76 are swung into their operative position by means of hydraulic cylindes 176 (see FIGS. 25–28).

Next, clamping table 42 is lowered to permit carriage 70 to move gassing manifold and top ejector plate 32 to its stand-by position. As tooling 24 moves downwardly, upper core box or cope 30 is deposited onto cope hangers 76 so that it is supported thereby. Bottom stool 26 and lower core box or drag 28 continue to move downwardly with clamping table 42, thus establishing the separation from cope 30 as shown in FIG. 50.

Figure 50:
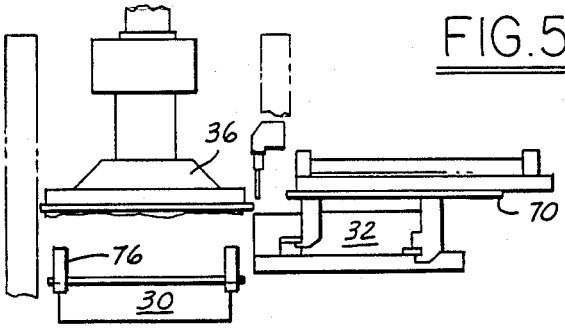
Figure 51:
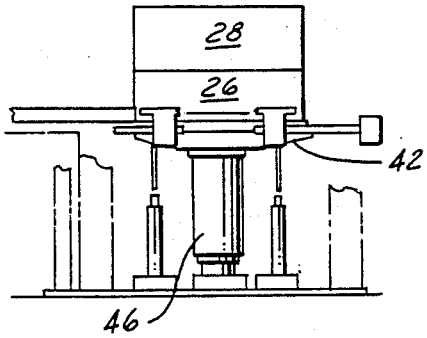
Figure 52:
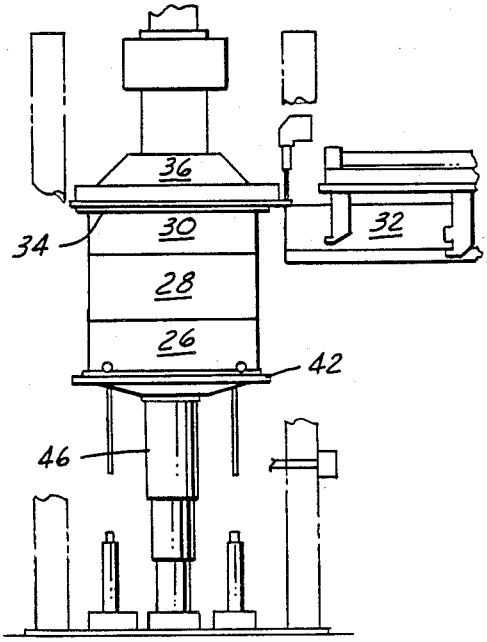
Figure 52:
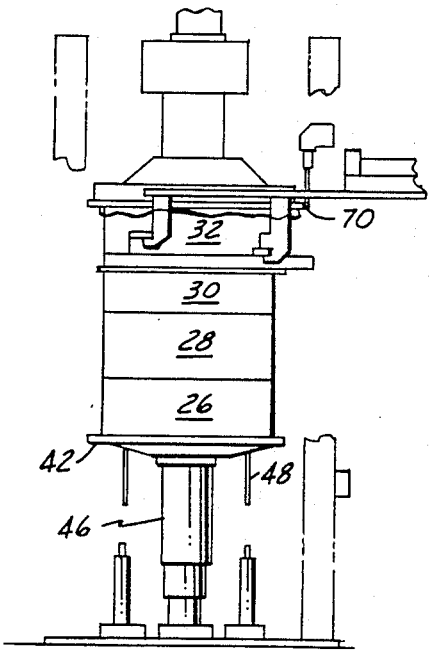

In the condition of FIG. 50, the machine is exactly as it would be if a completed part had been removed, and the machine is ready to start a repeat cycle to form another part. Hence, from this point on, the description of the sequence is the same for either a repetitive part-forming cycle or the formation of the first part with a newly-loaded complete set of tooling 24.

With the gassing manifold and ejector plate 32 out of the way, table 42 is once again raised, bringing drag 28 up into contact with cope 30 which is suspended on cope hangers 76. Continued upward movement of the table and tooling lifts cope 30 off of its hangers 76 and carries it upward until it engages blow plate 34. This is the condition of the apparatus illustrated in FIG. 51.

Next, sand and binder are introduced into hopper 52 and a butterfly valve (not illustrated) is opened by valve actuator 56 to admit this charge into sand magazine 36 (see FIG. 2). The butterfly valve is then closed and the sand magazine is pressurized with air from tank 62. This pressurization forces the sand from the magazine through blow plate 34 and into the core-defining cavity within the core boxes, thereby forming the core.

After the core is intially formed, table 42 is lowered a sufficient distance to permit carriage 70 to transfer gassing manifold and ejector plate 32 into position beneath blow plate 34. Table 42 is once again raised to engage the underside of the gassing manifold and ejector plate. This upward movement brings gas pipe connection 282 on the gassing manifold into sealing contact with fixed gas supply pipe 284 (see FIGS. 36–37). This is the condition illustrated in FIG. 52. Catalyzing gas is then introduced through these connections into the gassing manifold and ejector plate 32 and into the core boxes, catalyzing and hardening the newly-formed core. Purging air is then applied to the mold box cavity through the same path as the gas to remove excess gas.

During or immediately following the gassing step, cope hangers 76 are swung back into their operative position. Table 42 is lowered, and simultaneously top ejector pins 280 are actuated by hydraulic cylinder 262 (see FIG. 33) and lower ejector cylinders 50 are actuated. As table 42 starts downwardly, cope 30 engages cope hangers 76 and becomes supported thereby while table 42 and drag 28 continue down. As the two mold boxes separate, the top ejector plate is no longer constrained by the parting line pins and can move downwardly under the pressure from cylinder 262. Top ejector pins force core 388 out of the cope cavity. Meanwhile, lower ejector pin actuators 48 descend into contact with the upwardly extended rods of lower ejector cylinders 50, camming actuators 48 up into engagement with the lower ejector pin mechanism within bottom stool 26, thereby extending lower ejector pins 390 therefrom, and ejecting core 388 from drag 28. The fingers of pick-off unit 100 are then swung to their active position by rotary actuator 102 (see FIG. 6).

Figure 53:
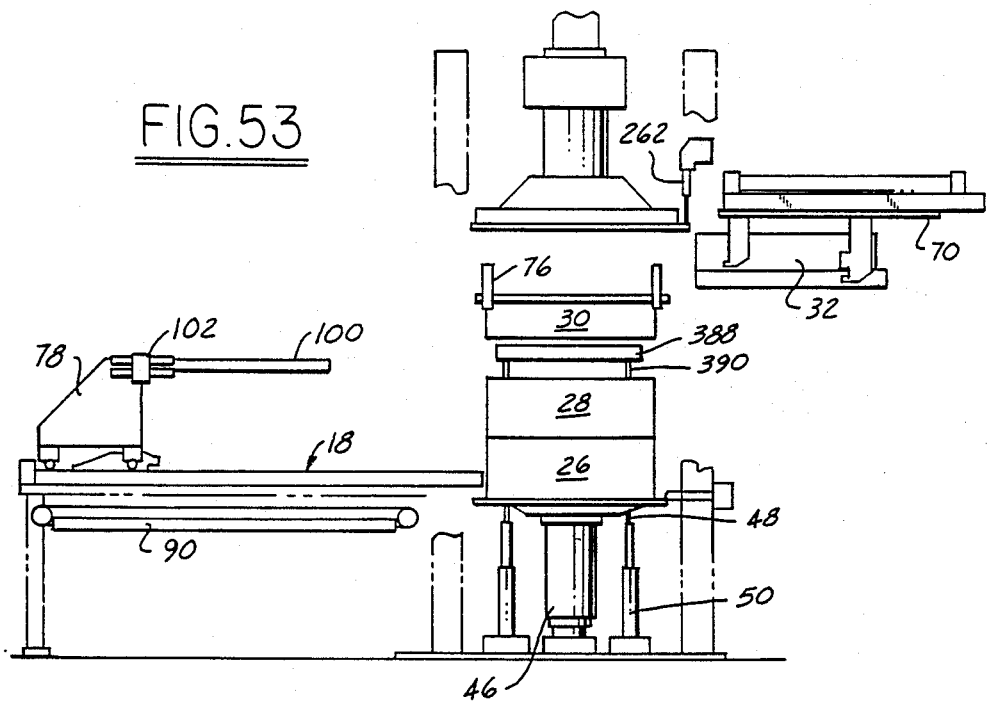

Referring next to FIG. 53, core 388 is shown supported on lower ejector pins 390, with sufficient gap above drag 28 to permit the fingers of pick-off unit 100 to enter. Carriage transfer cylinder 90 is actuated to cause carriage 82 and trolley 78 to traverse toward the right as viewed in FIG. 53 so that the pick-off fingers 100 are properly positioned beneath core 388. Lower ejector cylinders 50 are then retracted so that core 388 is gently placed onto and supported by the pick-off unit fingers. Trolley 78 is then retracted towards its stand-by position shown in FIG. 53, from which the core can be removed either manually or by robotic equipment.

It should be noted that FIG. 53 shows gassing manifold and ejector plate 32 in its retracted position. The withdrawal of that unit by carriage 70 can occur as soon as part 388 has been ejected from the molds. However, it may be preferable to defer such withdrawal until after part 388 has been removed by fingers 100, because gas vapors which may be harmful to the blow fan may be still given off by part 388 after its ejection. The gassing manifold and ejector plate 32, if temporarily left in place on cope 30, can shield such vulnerable parts from these vapors.

If another part is to be formed using the same tooling, table 46 is then raised to carry stool 26, drag 28 and cope 30 up into engagement with blow plate 34, whereupon the cycle can be repeated. Alternatively, if the tooling is to be removed, gassing manifold and ejector plate 32 is returned to its position beneath blow plate 34 (if it was not previously left in such position), and work table 42 is raised to carry stool 26, drag 28, cope 30 and gassing manifold and ejector plate 32 up into engagement with blow plate 34, with empty carriage 70 first being withdrawn to its stand-by position when cope 30 is raised far enough to engage and support gassing manifold and ejector plate 32. Clamps 318 and 350 (see FIGS. 45–46) are then released to disengage sand magazine 36 from blow plate 34 and from blow body 54. While work table 42 is in its raised position, pivotable rails 40 are swung back into their operative position. Table 42, with all of the tooling 24 stacked thereon, may then be lowered to bring wheels 38 of stool 26 to rest on tracks 40, whereupon carriage 82 is actuated toward the right by cylinder 90 so that gripper jaws 96 can engage tooling coupling 98 on tooling 24. Then, carriage 82 is returned to its stand-by position, bringing the tooling 24 onto tool-loading and pick-off table 18.

This invention may be further developed within the scope of the following claims. Accordingly, the foregoing specification is to be interpreted as illustrative of a single operative embodiment, rather than in a strictly limited sense.

We claim:

1. In a foundry machine for forming a part from molding material and which is characterized by a mainframe (10), a work table (42) mounted on the mainframe for support tooling (24) including lower and upper cooperating mold boxes (28, 30) during portions of the machine operating cycle, each of the mold boxes having a cavity therein which jointly define a cavity in which the part is to be formed, table transfer means (46) mounted on the mainframe (10) for transferring the work table (42) between various loading, part-forming and part-removing positions, and supply means (52, 54) mounted on the mainframe for supplying molding material to the mold boxes (28, 30), the improved gassing manifold (32) comprising:

an enclosed, substantially gas-tight chamber (281) for containing gas and defined by spaced upper and lower chamber-defining plates (270, 278), said upper and lower plates being connected in fixed relationship to each other;

gas pipe connector means (282) for establishing a gas connection between said chamber (281) and a source of catlyzing gas (290) on the mainframe (10);

a plurality of upper part ejector pins (280) extending from the interior of said chamber (281) downwardly through ejector pin openings in said lower plate (278);

ejector pin actuating means (266, 272) mounted on the exterior of said upper plate (270) and operatively interconnected with said ejector pins (280) within said chamber (281), said actuating means (266, 272) being adapted to be selectively operated by an ejector pin operator (262, 264) mounted on the mainframe (10) to cause said ejector pins (280) to stroke downwardly from said gassing manifold (32) and into aligned cylinder pin openings in the upper mold box (30) to eject a part (388) therefrom;

and gas exit ports in said lower plate (278) for providing an exit path for catalyzing gas from said chamber (281) to aligned gas openings in the upper mold box (30).

2. The gassing manifold (32) of claim 1 wherein said ejector pin openings in said lower plate (278) also serve as said gas exit ports.

3. The gassing manifold (32) of claim 1 which further comprises external coupling formation (74) adapted to be engaged by gassing manifold transfer means (68, 70, 72, 73) mounted on the mainframe (10) for laterally transferring said gassing manifold (32) into and out of alignment with said top face of the upper mold box (30).

4. In a foundry machine for forming a part from molding material and which is characterized by a mainframe (10), a work table (42) mounted on the mainframe for supporting tooling (24) including lower and upper cooperating mold boxes (28, 30) during portions of the machine operating cycle, the mold boxes each having a cavity therein and jointly defining a cavity in which the part is to be formed, table transfer means (46) mounted on the mainframe (10) for transferring the work table (42) between various loading, part-forming and part-removing positions, and supply means (52, 54) mounted on the mainframe for supplying molding material to the mold boxes (28, 30), the improved apparatus for handling tooling within a foundry machine comprising:

first power-operated clamping means (360, 376, 378) mounted on the mainframe (10) for selectively clamping a molding material magazine (36) to the molding material supply means (52, 54) when said molding material magazine (36) is conveyed into a clamping position adjacent said molding material supply means (52, 54) to allow removal of said magazine (36) from said machine;

transfer means (68, 70) mounted on said mainframe (10) for selectively engaging a combined gassing manifold and upper ejector pin unit (32) and laterally transferring said unit (32) between an operative position above said upper mold box (30) and a stand-by position laterally removed from the upper mold box (30), said combined manifold and upper ejector pin ejector unit (32) including a gas chamber (281);

mold box separating means (76) mounted on the mainframe (10) for separating the upper and lower mold boxes (30, 28) from each other prior to and during part ejection and part removal therefrom;

second power-operated clamping means (202, 186) mounted on the work table (42) for clamping the lowermost element (26) of the tooling (24) onto the work table (42); and, an ejector pin mounting plate (274) shiftably mounted within said chamber (281), said combined manifold upper ejector pin unit (32) including ejector pins (280) mounted on said ejector pin mounting plate (274).

5. The improved apparatus of claim 4 which further comprises second power-operated clamp actuator means (294, 298) mounted on the mainframe (10) for selectively engaging and actuating said second power-operated clamp means (318) adapted to clamp together said molding material magazine (36) and a blow plate (34) positioned immediately beneath said molding material magazine (36), said second power-operated clamp means (318) being mounted on one of said molding material magazines (36) and said blow plate (34).

6. The improved appartus of claim 4 wherein said mold box separating means (76) comprises hangers (76) mounted for lateral movement between a stand-by position providing clearance for the tooling (24) to be vertically conveyed by the work table (42) and an operating position in which the downwardly moving upper mold box (30) engages said hangers (76) as the work table (42) moves down, thereby arresting further movement of the upper mold box and supporting the upper mold box (30) as the lower mold box (28) continues downward on the work table (42).

7. The improved apparatus of claim 4, including ejector pin actuating means (266, 272) for actuating said ejector pins (280), said ejector pin actuating means (266, 272) including a plurality of push rods (272) engaging said ejector pin mounting plate (274).

8. In a foundry machine for forming a part from molding material and which is characterized by a mainframe (10), a work table (42) mounted on the mainframe for supporting tooling (24) including lower and upper cooperating mold boxes (28, 30) during portions of the machine operating cycle, each of the mold boxes having a cavity therein which jointly define a cavity in which the part is to be formed, table transfer means (46) mounted on the mainframe (10) for transferring the work table (42) between various loading, part-forming and part-removing positions, and supply means (52, 54) mounted on the mainframe for supplying molding material to the mold boxes (28, 30), the improved gassing manifold (32) comprising:

an enclosed gas chamber (281) for containing gas and defined by spaced upper and lower connected plates (270, 278);

gas pipe connector means (282) for establishing a gas connection between said chamber (281) and a source of catalyzing gas (290) on the mainframe (10);

a plurality of upper part ejector pins (280) extending from the interior of said chamber (281) downwardly through ejector pin openings in said lower plate (278);

ejector pin actuating means (266, 272) mounted on the exterior of said upper plate (270) and operatively interconnected with said ejector pins (280) within said chamber (281), said actuating means (266, 272) being adapted to be selectively operated by an ejector pin operator (262, 264) mounted on the mainframe (10) to cause said ejector pins (280) to stroke downwardly from said gassing manifold (32) and into aligned ejector pin openings in the upper mold box (30) to eject a part (388) therefrom;

gas exit ports in said lower plate (278) for providing an exit path for catalyzing gas from said chamber (281) to aligned gas openings in the upper mold box (30); and, an external coupling formation (74) adapted to be engaged by gassing manifold transfer means (68, 70, 72, 73) mounted on the mainframe (10) for laterally transferring said gassing manifold (32) into and out of alignment with said top face of the upper mold box (30);

said gas pipe connector means (282) including a first portion (282) secured to and movable along with said chamber (281) and a second portion (290) distinct from said first portion (282) and stationarily mounted on said mainframe (10) such that said first and second portions are relatively movable when said gassing manifold is laterally transferred by said gassing manifold transfer means (68, 70, 72, 73).

9. The gassing manifold of claim 8, wherein said first and second portions (282, 290) respectively include a pair of pins releasably held in axially aligned, end-to-end, abutting relationship with each other.

10. Improved apparatus for forming a part from molding material, and of the type including the combination of a mainframe (10), a pair of cooperating mold boxes (28, 30) mounted on said mainframe (10) for movement relative to each other and defining a mold cavity in which the part is formed, means (52, 54) for introducing molding material into said cavity, means (32) for introducing a gas into said cavity to cure said molding material within said cavity, and means (280) for ejecting the part from said mold boxes (28, 30) after said molding material has been cured, wherein the improvement comprises:

said gas introducing means including an enclosed, substantially gas-tight chamber (281) for containing said gas and defined by first and second spaced apart, chamber-defining plates (270, 278), said plates (270, 278) being connected in fixed relationship to each other, said first plate (270) including a plurality of openings therein;

said gas introducing means (32) including means (282, 290) for delivering said gas into said gas chamber (281);

said ejector means including a plurality of part ejector pins (280) respectively extending through said openings in said first plate (278);

means (274) disposed within said chamber (281) for mounting said ejector pins (280) within said chamber (281); and, means (266, 272) connected with said ejector pin mounting means (274) for driving said ejector pin mounting means (274) to cause said ejector pins (280) to stroke through said openings into contact with a cured part to eject said part from one of said mold boxes.

11. The improved apparatus of claim 10, wherein said mounting means includes a shiftable ejector plate (274)

mounted within said chamber, and said ejector pins (280) are secured to one of said ejector plates in respectively aligned relationship to said certain openings.

12. The improved apparatus of claim 11, including means (276) within said chamber for normally biasing said ejector plate to shift in one direction said that said ejector pins (280) retract from said mold boxes.

13. The improved apparatus of claim 11, including means (266, 272) mounted on the exterior surface of said chamber and connected with said ejector plate for driving said ejector plate to shift.

14. The improved apparatus of claim 13, wherein said driving means (266, 272) is mounted on said second plate (270).

15. The improved apparatus of claim 10, wherein said openings in said first plate are aligned with openings in said mold boxes (28, 30) and are configured to allow gas in said chamber (281) to flow into said mold cavity.

* * * * *